US010900360B2

(12) United States Patent
Teramoto

(10) Patent No.: US 10,900,360 B2
(45) Date of Patent: Jan. 26, 2021

(54) FAN, OUTDOOR UNIT, AND REFRIGERATION CYCLE APPARATUS

(71) Applicant: Mitsubishi Electric Corporation, Tokyo (JP)

(72) Inventor: Takuya Teramoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 51 days.

(21) Appl. No.: 15/766,944

(22) PCT Filed: Nov. 2, 2015

(86) PCT No.: PCT/JP2015/080935
§ 371 (c)(1),
(2) Date: Apr. 9, 2018

(87) PCT Pub. No.: WO2017/077575
PCT Pub. Date: May 11, 2017

(65) Prior Publication Data

US 2018/0306034 A1 Oct. 25, 2018

(51) Int. Cl.
*F01D 5/14* (2006.01)
*F04D 29/32* (2006.01)
(Continued)

(52) U.S. Cl.
CPC ..... *F01D 5/141* (2013.01); *F04D 29/329* (2013.01); *F04D 29/384* (2013.01); *F04D 25/12* (2013.01); *F04D 29/324* (2013.01)

(58) Field of Classification Search
CPC ... F01D 5/12; F01D 5/14; F01D 5/141; F04D 29/32; F04D 29/324; F04D 29/325;
(Continued)

(56) References Cited

U.S. PATENT DOCUMENTS

2006/0008346 A1* 1/2006 Ku ..... F04D 29/329 415/143
2009/0022588 A1* 1/2009 Chen ..... F04D 25/0613 415/218.1
(Continued)

FOREIGN PATENT DOCUMENTS

CN 101835990 A 9/2010
DE 62 510 C 6/1892
(Continued)

OTHER PUBLICATIONS

International Search Report of the International Searching Authority dated Feb. 9, 2016 for the corresponding international application No. PCT/JP2015/080935 (and English translation).
(Continued)

*Primary Examiner* — Courtney D Heinle
*Assistant Examiner* — Elton K Wong
(74) *Attorney, Agent, or Firm* — Posz Law Group, PLC

(57) ABSTRACT

A fan is equipped with a boss, a first blade member, and a second blade member. The boss has: a first end and a second end an axial direction; an inclined surface inclined, in a direction from the second end to the first end, toward an axial center extending in the axial direction; and an outer peripheral surface located between the inclined surface and the second end. The boss is rotatable about the axial center. The first blade member is connected to the outer peripheral surface of the boss. The second blade member is connected to at least one of the inclined surface or the outer peripheral surface located between the inclined surface and a connecting portion where the first blade member is connected to the outer peripheral surface.

8 Claims, 19 Drawing Sheets

(51) Int. Cl.
*F04D 29/38* (2006.01)
*F04D 25/12* (2006.01)

(58) Field of Classification Search
CPC .... F04D 29/327; F04D 29/328; F04D 29/329; F04D 29/38; F04D 29/384; F04D 25/12
See application file for complete search history.

(56) References Cited

U.S. PATENT DOCUMENTS

| | | | | |
|---|---|---|---|---|
| 2009/0110558 | A1* | 4/2009 | Choi | F04D 29/384 416/223 R |
| 2015/0003992 | A1* | 1/2015 | Kojima | F04D 29/263 416/234 |
| 2016/0282005 | A1* | 9/2016 | Kim | H02P 21/00 |

FOREIGN PATENT DOCUMENTS

| | | | |
|---|---|---|---|
| JP | H02-100135 | A | 4/1990 |
| JP | H02-100135 | U | 8/1990 |
| JP | H02-252999 | A | 10/1990 |
| JP | H05-296495 | A | 11/1993 |
| JP | H06-264897 | A | 9/1994 |
| JP | 2010-255560 | A | 11/2010 |
| JP | 202833301 | U | 3/2013 |
| JP | 2014-001717 | A | 1/2014 |
| JP | 5611277 | B2 | 10/2014 |
| JP | 203948346 | U | 11/2014 |
| WO | 2009054601 | A1 | 4/2009 |

OTHER PUBLICATIONS

Extended European Search Report dated Oct. 15, 2018 issued in corresponding EP patent application No. 15907761.9.
Office action dated Feb. 26, 2019 issued in corresponding JP patent application No. 2017-548540 (and English translation thereof).
Office Action dated Jun. 3, 2019 issued in corresponding CN patent application No. 201580084361.1 (and English translation).
Office Action dated May 27, 2019 issued in corresponding KR patent application No. 10-2018-7011360 (and English translation).
Office Action dated Feb. 3, 2020 issued in corresponding CN patent application No. 201580084361.1 (and English translation).
Office Action dated Jan. 31, 2020 issued in corresponding in patent application No. 201847014657.
Office Action dated Aug. 4, 2020 issued in corresponding CN patent application No. 201580084361.1 (and English translation).

* cited by examiner

FAN, OUTDOOR UNIT, AND REFRIGERATION CYCLE APPARATUS

CROSS REFERENCE TO RELATED APPLICATION

This application is a U.S. national stage application of PCT/JP2015/080935 filed on Nov. 2, 2015, the contents of which are incorporated herein by reference.

TECHNICAL FIELD

The present invention relates to fans, outdoor units, and refrigeration cycle apparatuses.

BACKGROUND ART

A refrigeration cycle apparatus circulates refrigerant through a refrigerant circuit so as to cause a space or the like to be heated or cooled, for example. The refrigeration cycle apparatus is commonly equipped with an indoor unit and an outdoor unit. The outdoor unit blows air (performs cooling, exhausts heat, for example) by rotating a fan (propeller fan) having blades (propeller blades) to generate airflow.

The conventional fan has a cylindrical boss to which blades (propeller blades) are connected. The boss has a downstream end covered with a flat plate. Japanese Patent Laying-Open No. H05-296495 (Patent Document 1) for example discloses an outdoor unit equipped with an axial flow fan having a boss whose downstream end is formed in a conical shape.

CITATION LIST

Patent Document

PTD 1: Japanese Patent Laying-Open No. H05-296495

SUMMARY OF INVENTION

Technical Problem

In the case where the downstream end of the boss is covered with a flat plate, air is hindered from flowing into the region located downstream of the boss, resulting in a large flow separation region. Large eddies are thus generated on the downstream side of the boss. Resultant problems are deterioration of pressure-flow characteristics and increase of noise. The outdoor unit disclosed in the above-referenced document can cause air to flow along the conical shape and enter the region located downstream of the boss. Thus, the flow separation region generated on the downstream side of the boss can be reduced. The boss whose downstream end is merely formed in the conical shape, however, is not enough to cause air to flow sufficiently along the conical shape and enter the region downstream of the boss. It is therefore difficult to sufficiently reduce the flow separation region generated on the downstream side of the boss.

The present invention has been made in view of the above problems, and an object of the present invention is to provide fans, outdoor units, and refrigeration cycle apparatuses that enable the flow separation region generated on the downstream side of the boss to be reduced sufficiently.

Solution to Problem

A fan of the present invention includes a boss, a first blade member, and a second blade member. The boss has: a first end and a second end; an inclined surface inclined, in a direction from the second end to the first end, toward an axial center extending in the axial direction; and an outer peripheral surface located between the inclined surface and the second end, and the boss is rotatable about the axial center. The first blade member is connected to the outer peripheral surface of the boss. The second blade member is connected to at least one of the inclined surface or the outer peripheral surface located between the inclined surface and a connecting portion where the first blade member is connected to the outer peripheral surface.

Advantageous Effects of Invention

Regarding the fan of the present invention, airflow in the direction from the second end to the first end generated by rotation of the first blade member can be rectified by the second member. The airflow can therefore be passed sufficiently along the inclined surface. The flow separation region generated on the downstream side of the boss can thus be made sufficiently smaller.

DESCRIPTION OF EMBODIMENTS

In the following, embodiments of the present invention are described based on the drawings.

First Embodiment

First, a configuration of an outdoor unit in a first embodiment of the present invention is described. Regarding the present embodiment, an outdoor unit for an air conditioning apparatus is described as an example of the outdoor unit. The outdoor unit in the present embodiment may be an outdoor unit for a water heater, for example. This outdoor unit can be configured similarly to the outdoor unit for an air conditioning apparatus.

Figure 1:
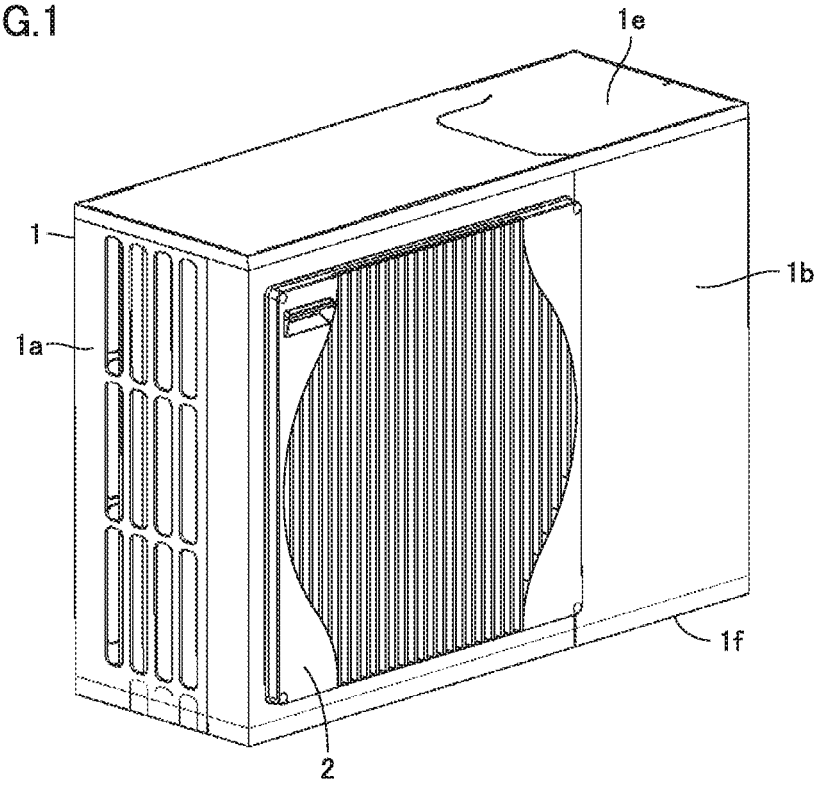
FIG. 1 is a perspective view showing an outdoor unit in a first embodiment of the present invention.
Figure 2:
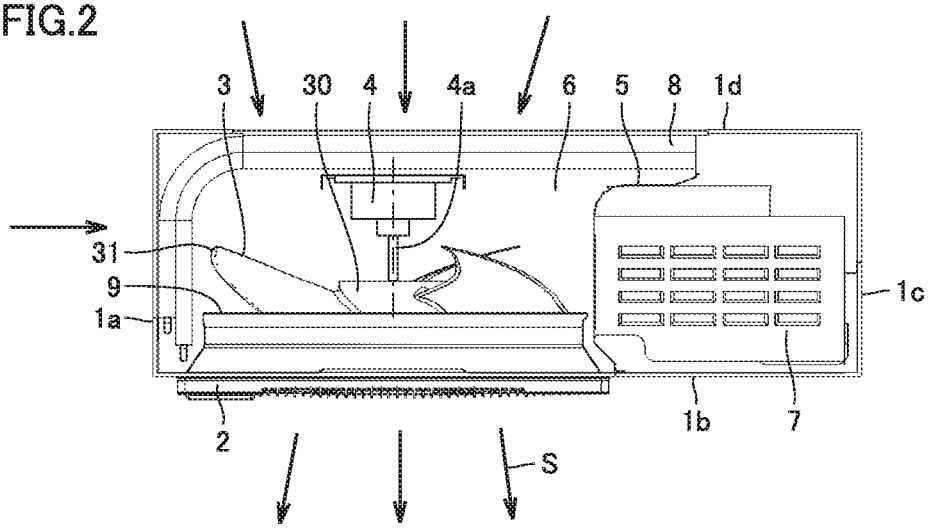
FIG. 2 is a diagram for illustrating a configuration of the outdoor unit in the first embodiment of the present invention.

FIG. 1 is a perspective view of an outdoor unit in the first embodiment of the present invention as seen from the front side. FIG. 2 is a diagram for illustrating an internal configuration of the outdoor unit as seen from above the outdoor unit in the first embodiment of the present invention. With reference to FIGS. 1 and 2, the outdoor unit mainly includes an outdoor unit body 1, a fan grille 2, a fan 3, a fan motor 4, a partition plate 5, a fan chamber 6, a machine chamber 7, a heat exchanger 8, and a bell mouth 9.

Outdoor unit body 1 is formed of a casing having a first side 1*a*, a front side 1*b*, a second side 1*c*, a back side 1*d*, an upper side 1*e*, and a bottom side 1*f*. First side 1*a* and back side 1*d* each have openings for sucking outside air into outdoor unit body 1.

Figure 3:
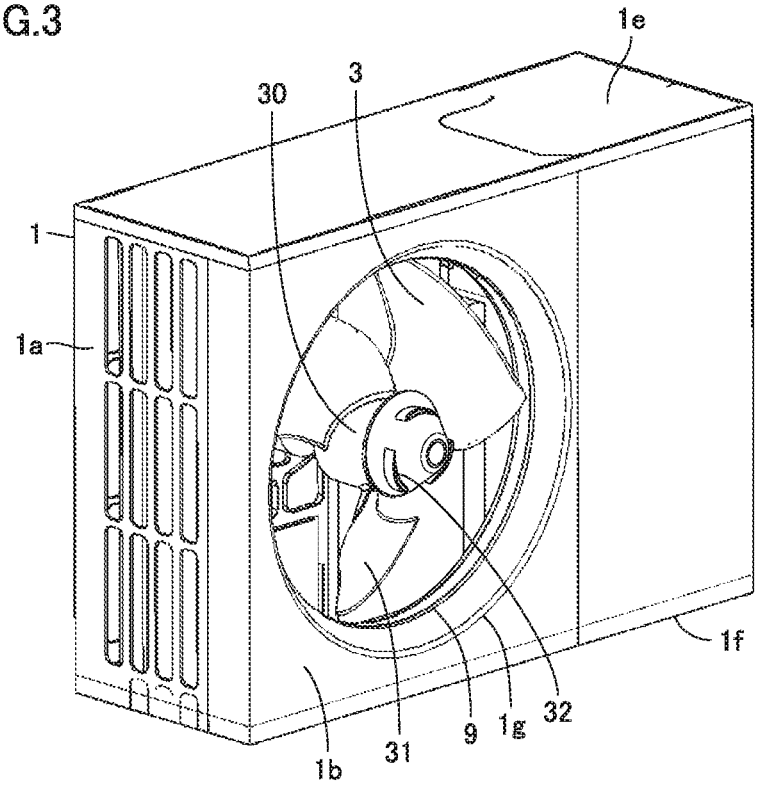
FIG. 3 is a perspective view showing a state where a fan grille of the outdoor unit in the first embodiment of the present invention has been removed.

With reference to FIGS. 1 and 3, front side 1*b* has an opening functioning as an outlet 1*g* through which air is blown to the outside. Outlet 1*g* is covered with fan grille 2. Fan grille 2 functions to prevent contact between fan 3 and an object or the like so as to ensure safety.

FIG. 3 is a diagram showing a configuration of the outdoor unit in the first embodiment of the present invention in a state where fan grille 2 covering outlet 1*g* of the outdoor unit has been removed. With reference to FIGS. 2 and 3, fan 3 is disposed in outdoor unit body 1. In the present embodiment, fan 3 is a propeller fan. Fan 3 has a boss (propeller boss) 30, a first blade member 31, and a second blade member 32. First blade member 31 and second blade member 32 of fan 3 are located on the periphery of boss 30.

Fan 3 is driven to rotate by fan motor 4. Fan motor 4 is connected to fan 3 through a rotational shaft 4*a*. Fan motor 4 is configured to be capable of transmitting rotational driving force to fan 3 through rotational shaft 4*a*. In the front-back direction of outdoor unit body 1, fan motor 4 is located between fan 3 and heat exchanger 8. The inside of outdoor unit body 1 is divided by partition plate 5 into fan chamber 6 and machine chamber 7.

Figure 4:
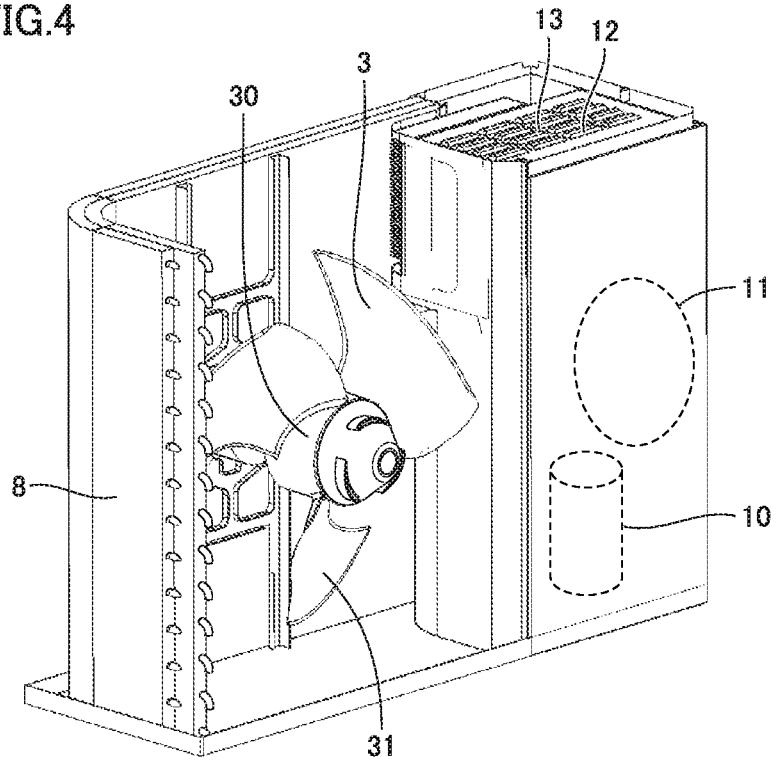
FIG. 4 is a diagram for illustrating an internal configuration of the outdoor unit in the first embodiment of the present invention.

FIG. 4 is a diagram showing the configuration of the outdoor unit in a state where some parts such as first side 1*a* and a part of front side 1*b* have been removed for illustrating an internal configuration for example of outdoor unit body 1 in the first embodiment of the present invention. With reference to FIGS. 2 and 4, fan 3, fan motor 4, heat exchanger 8, and bell mouth 9 are disposed in fan chamber 6. A compressor 10, a pipe 11, and a board box 12 are disposed in machine chamber 7.

In fan chamber 6, heat exchanger 8 that is substantially in an shape is disposed inside first side 1*a* and back side 1*d*. Heat exchanger 8 is configured to exchange heat with air guided by fan 3. Heat exchanger 8 is located on the inlet side of fan 3. Heat exchanger 8 is located between first side 1*a* and fan 3 and located between back side 1*d* and fan 3. Heat exchanger 8 is placed in the shape extending along first side 1*a* and back side 1*d*. Heat exchanger 8 has a plurality of fins and heat transfer tubes, the fins are arranged side by side so that respective plate-like surfaces are in parallel with each other, and the heat transfer tubes penetrate each fin in the direction in which the fins are arranged. In the heat transfer tubes, refrigerant circulating through a refrigerant circuit flows. In heat exchanger 8, the heat transfer tubes each extend in an L shape along first side 1*a* and back side 1*d* of outdoor unit body 1. As shown in FIG. 4, the heat transfer tubes in multiple stages are configured to penetrate the tins.

Bell mouth 9 is attached to front side 1*b* of outdoor unit body 1. Bell mouth 9 may be integrated with front side 1*b* or separate bell mouth 9 may be attached to front side 1*b*. Bell mouth 9 is located along the boundary between the inlet side and the outlet side to form an air path in the vicinity of outlet 1*g*. Bell mouth 9 is configured to surround the outer periphery of outlet 1*g*. Bell mouth 9 is configured to extend in the rotational direction of first blade member 31. Bell mouth 9 is located outside the outer peripheral edge of first blade member 31, in the radial direction of fan 3. Fan grille 2 is attached to front side 1*b* of outdoor unit body 1 to cover bell mouth 9 from outside outdoor unit body 1.

Heat exchanger 8 is connected to compressor 10 through pipe 11 to form the refrigerant circuit of the air conditioning apparatus. A control board 13 placed in board box 12 controls devices mounted in the outdoor unit.

Figure 5:
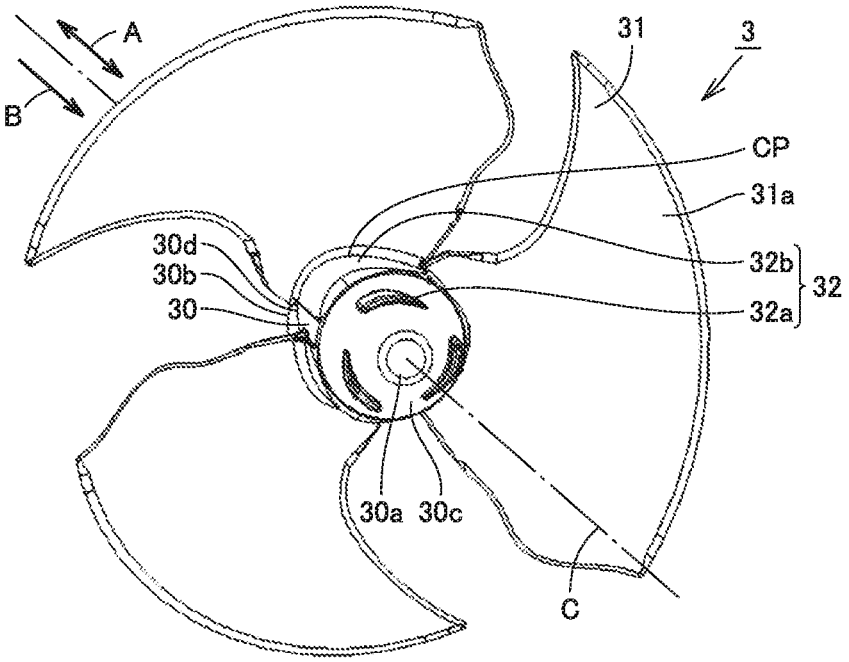
FIG. 5 is a perspective view of a fan in the first embodiment of the present invention as seen from the front side.
Figure 6:
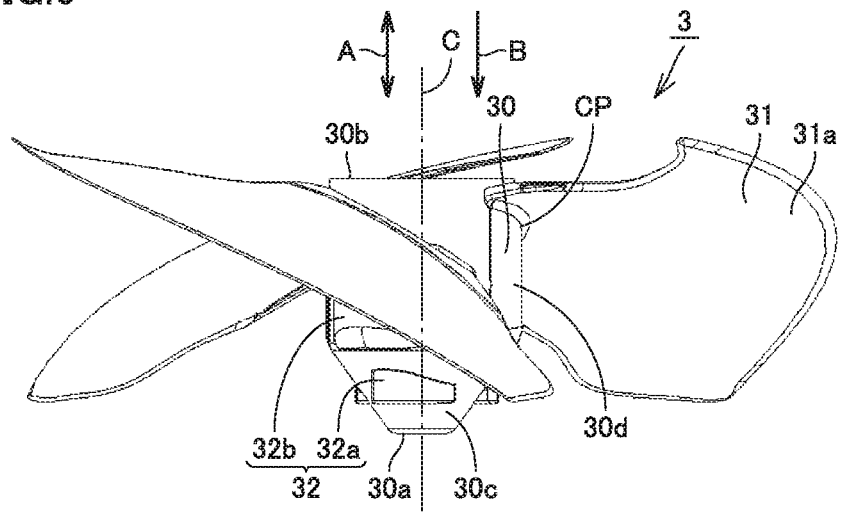
FIG. 6 is a side view showing the fan in the first embodiment of the present invention.

With reference next to FIGS. 5 to 8, the configuration of fan 3 in the present embodiment is described in further detail. FIG. 5 is a perspective view of fan 3 in the first embodiment of the present invention as seen from the front side (downstream side). FIG. 6 is a diagram of fan 3 in the first embodiment of the present invention as seen from a lateral side. With reference to FIGS. 5 and 6, fan 3 in the present embodiment has boss 30, first blade member 31, and second blade member 32.

Boss 30 forms a hub of fan 3. Boss 30 has a first end 30*a* and a second end 30*b* in an axial direction A, as well as an inclined surface 30*c* and an outer peripheral surface 30*d*. First end 30*a* is opposite to second end 30*b* in axial direction A. First end 30*a* has a flat plate shape. An axial center C extends in axial direction A. Boss 30 is configured to be rotatable about axial center C. Boss 30 is an axial body rotating about axial center C.

Inclined surface 30*c* is inclined toward axial center C in a direction B from second end 30*b* to first end 30*a*. In the present embodiment, inclined surface 30*c* has a conical shape. Inclined surface 30*c* is formed to have its radial size decreasing from outer peripheral surface 30*d* toward first end 30*a*.

Outer peripheral surface 30*d* is located between inclined surface 30*c* and second end 30*b*. Outer peripheral surface 30*d* connects to inclined surface 30*c*. Outer peripheral surface 30*d* has a cylindrical shape. The radial size of outer peripheral surface 30*d* is equal to or larger than the radial size of inclined surface 30*c*.

First blade member 31 is connected to outer peripheral surface 30*d* of boss 30. First blade member 31 is configured to be rotatable about axial center C of boss 30. First blade member 31 is configured to be capable of blowing air in direction B from second end 30*b* to first end 30*a*. In other words, first blade member 31 is configured to rotate about axial center C of boss 30 and thereby generate airflow toward the downstream side of boss 30.

First blade member 31 has a plurality of blades 31*a*. In the present embodiment, the number of blades 31*a* of first blade member 31 is three, for example. In the present embodiment, a plurality of blades 31*a* of first blade member 31 are each a propeller blade.

Second blade member 32 is configured to be rotatable about axial center C of boss 30. Second blade member 32 may be configured to be capable of blowing air in direction B from second end 30*b* to first end 30*a*. In other words, second blade member 32 may be configured to be capable of rotating about axial center C of boss 30 to thereby generate airflow toward the downstream side of boss 30. Specifically, second blade member 32 may have a taper whose cross-sectional area decreases in direction B from second end 30*b* to first end 30*a*.

In the present embodiment, second blade member 32 has a first blade 32*a* and a second blade 32*b*. A plurality of first blades 32*a* and a plurality of second blades 32*b* are disposed. The number of first blades 32*a* is three, for example. The number of second blades 32*b* is three, for example.

Figure 7:
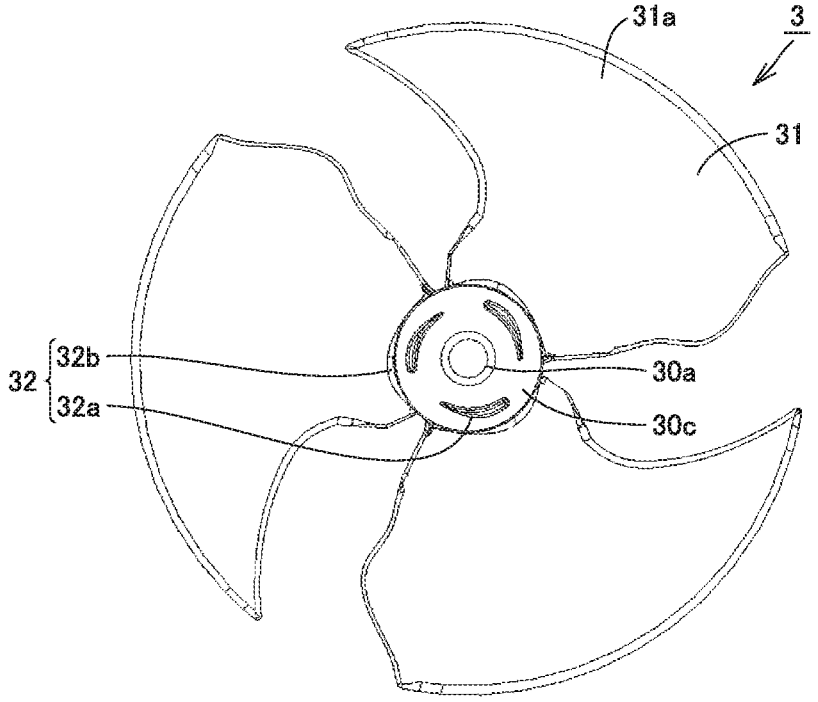
FIG. 7 is a front view of the fan in the first embodiment of the present invention.

FIG. 7 is a front view of fan 3 in the first embodiment of the present invention as seen from the axially downstream side. With reference to FIGS. 5 and 7, as seen in axial direction A, a plurality of first blades 32*a* are spaced from each other at regular angles in the direction of the circumference of boss 30 about axial center C, and a plurality of second blades 32*b* are also spaced from each other at regular angles in the same direction. As seen in axial direction A, a plurality of first blades 32*a* and a plurality of second blades 32*b* are identical to a plurality of blades 31*a* of first blade member 31, in terms of the angles at which the blades are spaced from each other in the direction of the circumference of boss 30 about axial center C.

Figure 8:
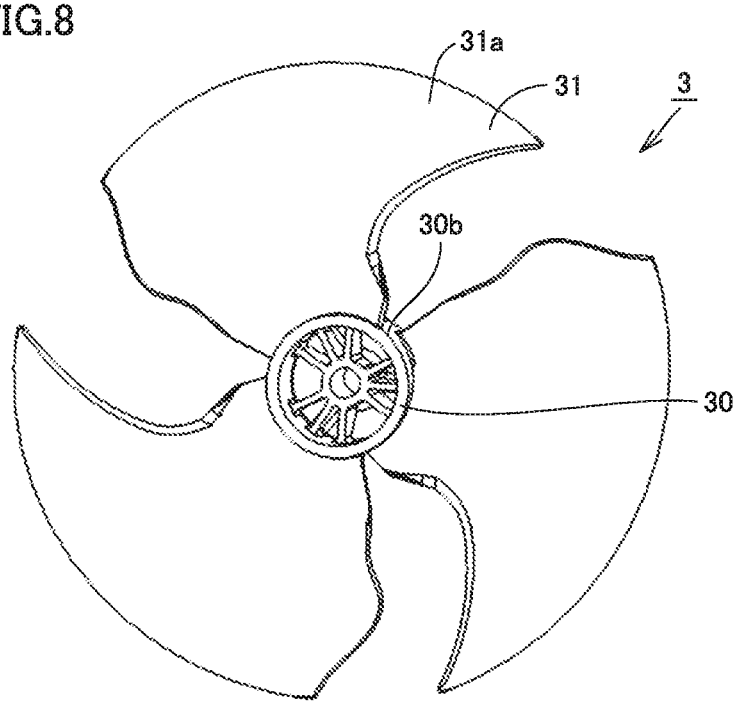
FIG. 8 is a perspective view of the fan in the first embodiment of the present invention as seen from the back side.

FIG. 8 is a perspective view of fan 3 in the first embodiment of the present invention as seen from the upstream side (air inlet side). With reference to FIG. 8, boss 30 has a hollow shape. Specifically, first end 30*a*, inclined surface 30*c*, and outer peripheral surface 30*d* of boss 30 are formed to have a thin thickness so that a space is formed inside these thin first end and inclined and outer peripheral surfaces. Openings are formed in second end 30*b* of boss 30.

With reference again to FIGS. 5 and 6, first blade 32*a* is connected to inclined surface 30*c*. Second blade 32*b* is connected to outer peripheral surface 30*d*. In other words, in the present embodiment, second blade member 32 is connected to both inclined surface 30*c* and outer peripheral surface 30*d*. The present embodiment, however, is not limited to this configuration. Second blade member 32 may be connected to at least one of inclined surface 30*c* or outer peripheral surface 30*d* located between inclined surface 30*c* and a connecting portion CP where first blade member 31 is connected to outer peripheral surface 30*d*.

Figure 9:
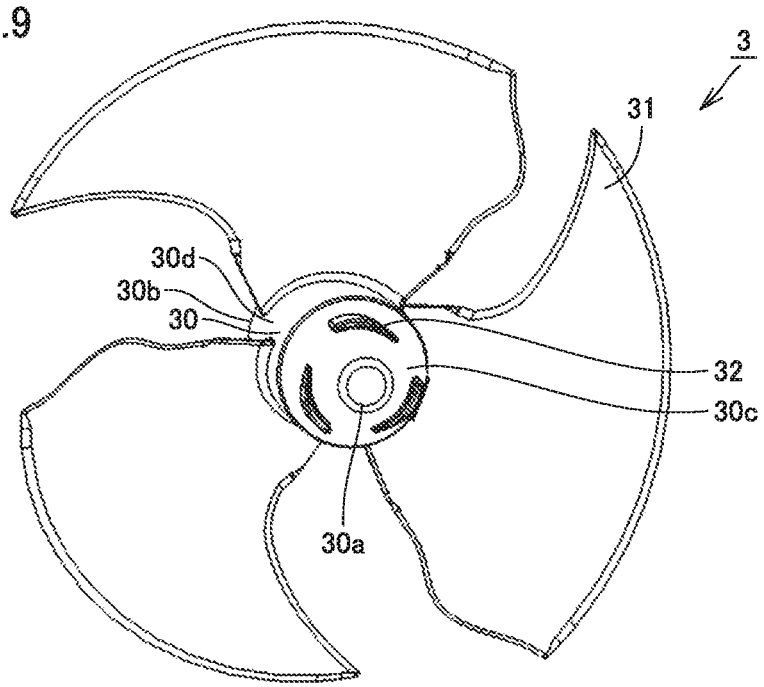
FIG. 9 is a perspective view showing a fan according to a first modification in the first embodiment of the present invention.
Figure 10:
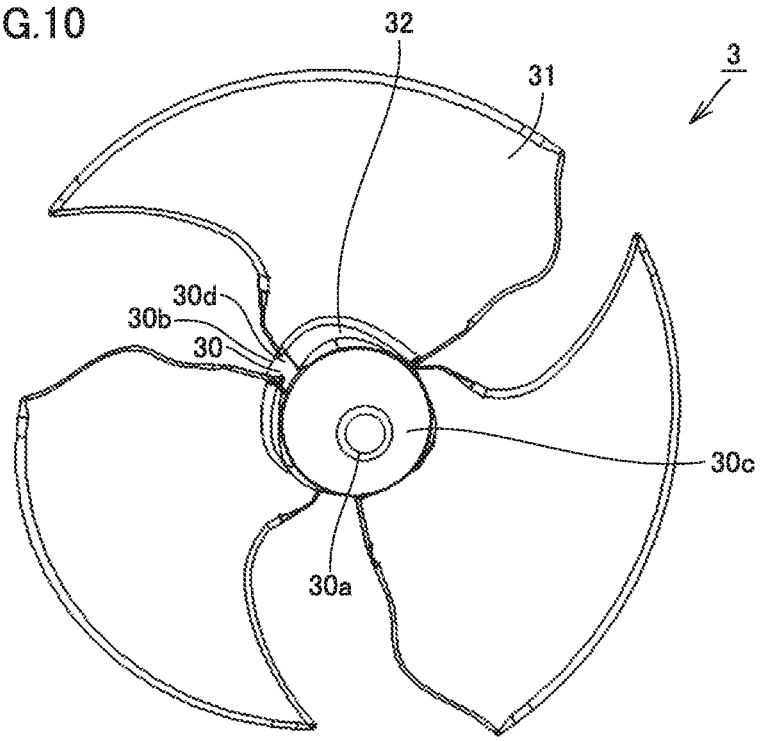
FIG. 10 is a perspective view showing a fan according to a second modification in the first embodiment of the present invention.

Specifically, like fans 3 according to first and second modifications in the present embodiment shown in FIGS. 9 and 10, second blade member 32 may be connected to either inclined surface 30*c* or outer peripheral surface 30*d*.

FIG. 9 is a perspective view of fan 3 according to the first modification in the first embodiment of the present invention as seen from the downstream side (air outlet side). With reference to FIG. 9, fan 3 according to the first modification in the present embodiment has second blade member 32 connected to inclined surface 30*c* but not connected to outer peripheral surface 30*d*. In other words, according to the first modification in the present embodiment, second blade member 32 is connected to inclined surface 30*c* only.

FIG. 10 is a perspective view of fan 3 according to the second modification in the first embodiment of the present invention as seen from the downstream side (air outlet side). With reference to FIG. 10, fan 3 according to the second modification in the present embodiment has second blade member 32 connected to outer peripheral surface 30*d* but not connected to inclined surface 30*c*. In other words, according to the second modification in the present embodiment, second blade member 32 is connected to outer peripheral surface 30*d* only.

Figure 11:
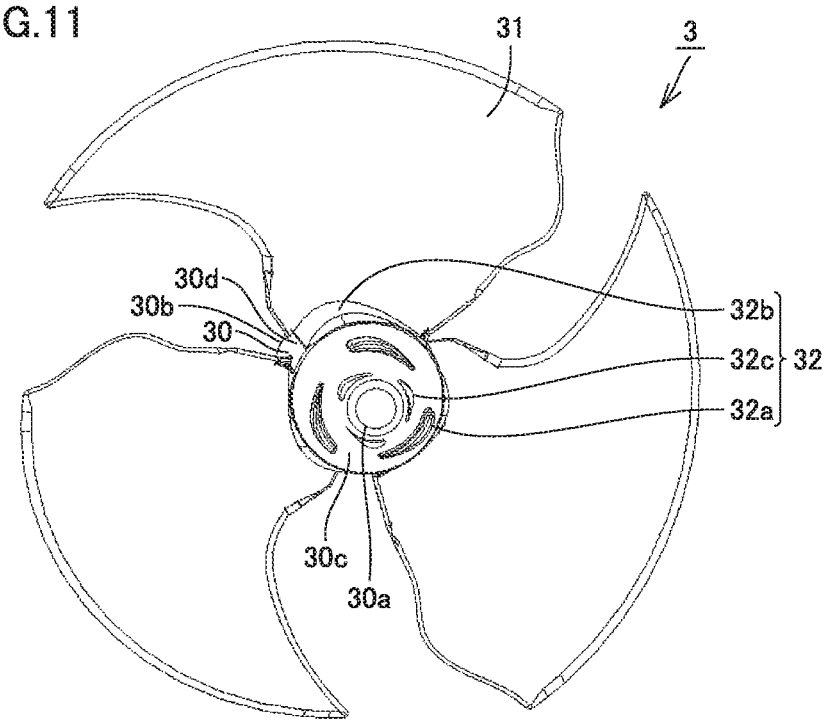
FIG. 11 is a perspective view showing a fan according to a third modification in the first embodiment of the present invention.

Next, another modification in the present embodiment is described. The above description is of the case where second blade member 32 has first blades 32*a* and second blades 32*b* as shown in FIG. 5. The present embodiment, however, is not limited to this configuration. Specifically, second blade member 32 may have additional blades. FIG. 11 is a perspective view of fan 3 according to a third modification in the first embodiment of the present invention, as seen from the downstream side (air outlet side). With reference to FIG. 11, fan 3 according to the third modification in the present embodiment has second blade member 32 including a third blade 32*c* in addition to first blade 32*a* and second blade 32*b*. A plurality of third blades 32*c* are placed. The number of third blades 32*c* is three, for example. Third blades 32*c* are arranged between first blades 32*a* and first end 30*a*. Third blades 32*c* are located inside in the radial direction of boss 30, relative to first blades 32*a*.

Figure 12:
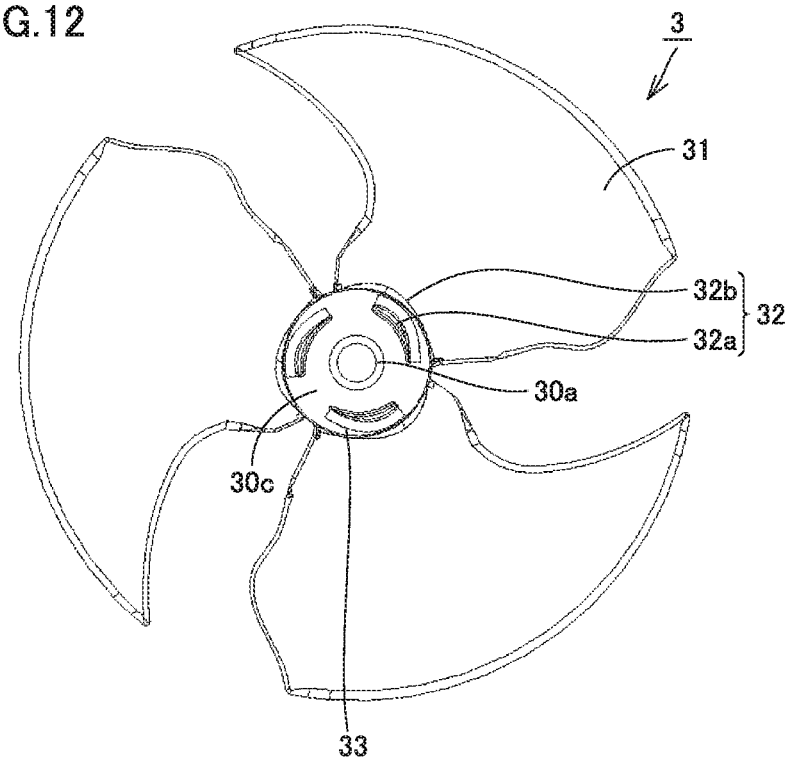
FIG. 12 is a front view showing a fan according to a fourth modification in the first embodiment of the present invention.

FIG. 12 is a front view of fan 3 according to a fourth modification in the first embodiment of the present invention as seen from the axially downstream side. With reference to FIG. 12, fan 3 according to the fourth modification in the present embodiment differs from fan 3 in the present embodiment shown in FIG. 7, in that the former has a through hole 33. Regarding fan 3 according to the fourth modification in the present embodiment, inclined surface 33*c* has through hole 33. Through hole 33 extends through the thickness of inclined surface 30*c*. A plurality of through holes 33 are formed. A plurality of through holes 33 are located outside respective first blades 32*a* in the radial direction of boss 30.

Next, with reference to FIGS. 2, 3, and 13 to 15, a description is given of an air blowing operation of the outdoor unit in the present embodiment as compared with a comparative example.

With reference to FIGS. 2 and 3, as fan 3 of the outdoor unit in the present embodiment rotates, air is sucked from the outside of outdoor unit body 1 into outdoor unit body 1. The air sucked into outdoor unit body 1 passes through heat exchanger 8 located along first side 1*a* or back side 1*d*. Accordingly, heat is exchanged between the air and refrigerant in heat exchanger 8. The air having undergone the heat exchange in heat exchanger 8 is passed through fan 3 and bell mouth 9 and blown from outlet 1*g* to the outdoors. At this time, airflow S guided from outlet 1*g* to the outdoors is generated as shown in FIG. 2.

Figure 13:
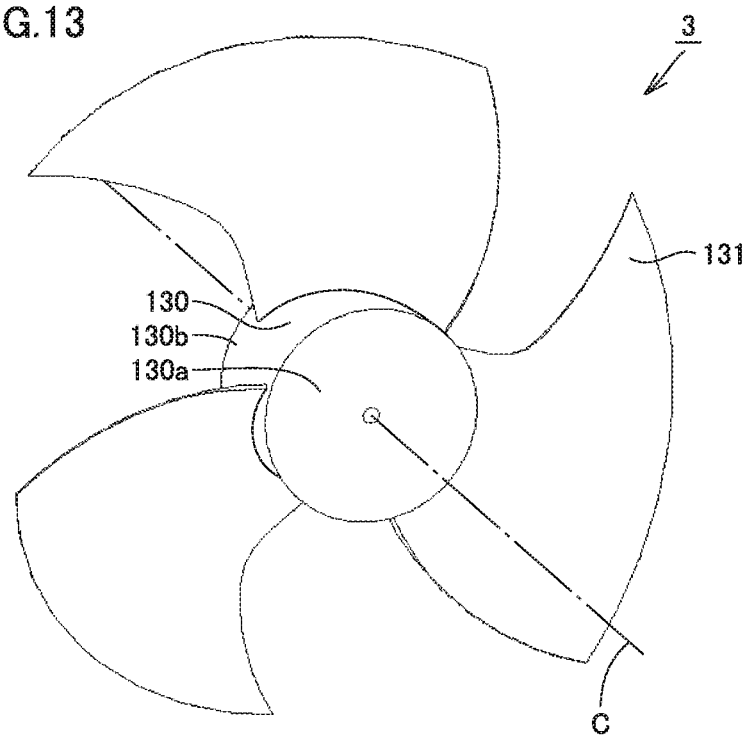
FIG. 13 is a perspective view snowing a fan in a comparative example.

Next, a description is given of the airflow passed through fan 3 in the present embodiment, as compared with a comparative example. FIG. 13 is a perspective view of a fan 3 in the comparative example, as seen from the downstream side (air outlet side). With reference to FIG. 13, fan 3 in the comparative example differs from fan 3 in the present embodiment in that the former does not have inclined surface 30*c* and second blade member 32 shown in FIG. 5.

Fan 3 in the comparative example has a boss 130 and a first blade member 131. Boss 130 has a top surface 130*a* and an outer peripheral surface 130*b*. Top surface 130*a* is formed of a flat plate. Top surface 130*a* is connected to the top of outer peripheral surface 130*b*. Top surface 130*a* is connected to outer peripheral surface 130*b* so that top surface 130*a* extends orthogonally to axial center C of boss 30. In other words, top surface 130*a* is connected at a right angle to outer peripheral surface 130*b*.

Figure 14:
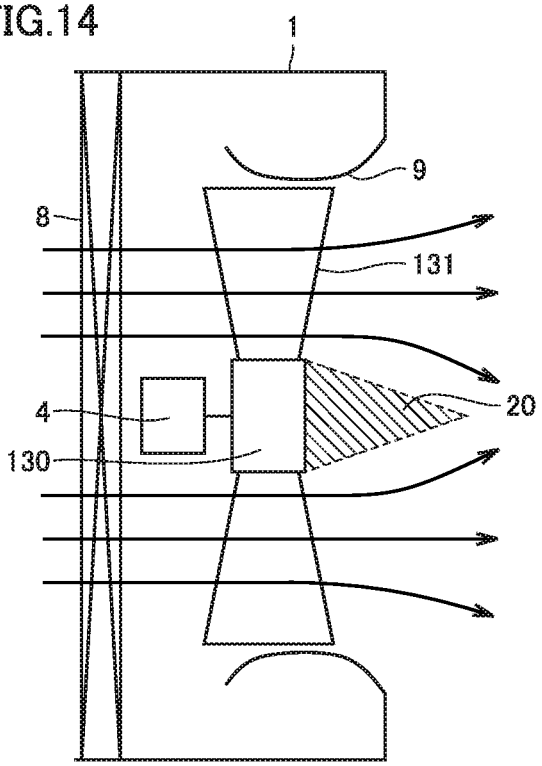
FIG. 14 is a diagram for illustrating airflow passing through an outdoor unit in the comparative example.

FIG. 14 is a diagram for illustrating airflow passing through the outdoor unit in the comparative example. With reference to FIG. 14, regarding fan 3 in the comparative example, top surface 130*a* and outer peripheral surface 130*b* of boss 130 are not inclined but connected to each other at a right angle. Airflow generated by rotation of first blade member 131 passes along outer peripheral surface 130*b* and thereafter separates at top surface 130*a*. Accordingly, a large flow separation region 20 is generated on the downstream side of top surface 130*a* in the direction of the airflow passing through fan 3.

Figure 15:
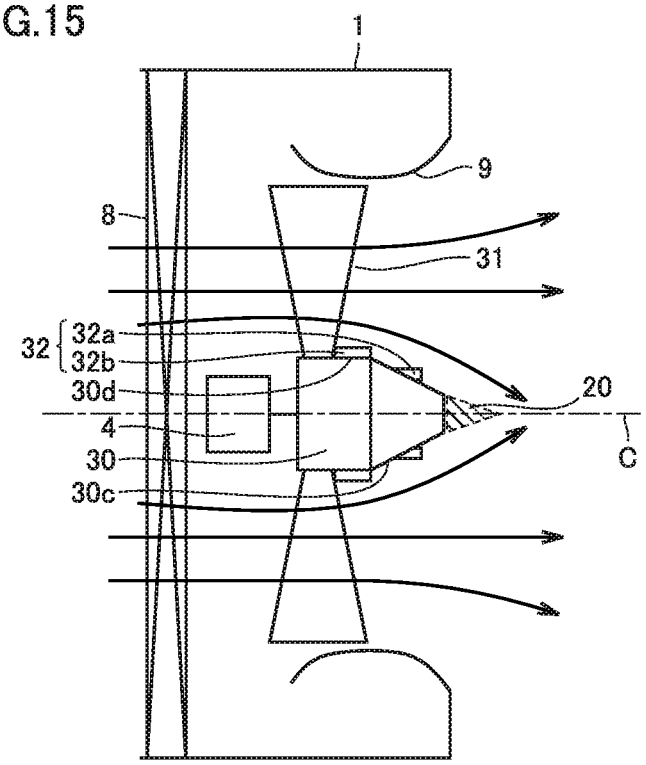
FIG. 15 is a diagram for illustrating airflow passing through the outdoor unit in the first embodiment of the present invention.

FIG. 15 is a diagram for illustrating airflow passing through the outdoor unit in the first embodiment of the present invention. With reference to FIG. 15, regarding fan 3 in the present embodiment, boss 30 has inclined surface 30*c*. Inclined surface 30*c* is inclined toward axial center C in the downstream direction. Airflow generated by rotation of first blade member 31 therefore passes along outer peripheral surface 30*d* and then along inclined surface 30*c*. Accordingly, a smaller flow separation region is generated on the downstream side of boss 30.

Further, regarding fan 3 in the present embodiment, first blade 32*a* is connected to inclined surface 30*c* and second blade 32*b* is connected to outer peripheral surface 30*d*. Rotation of second blade member 32 placed on both inclined surface 30*c* and outer peripheral surface 30*d* causes a negative pressure in the region where second blade member 32 rotates. The airflow therefore enters the region where second blade member 32 rotates. The airflow is thus drawn toward inclined surface 30*c* and outer peripheral surface 30*d*. The airflow generated by rotation of first blade member 31 thus flows toward the downstream side of boss 30 while drawn toward inclined surface 30*c* and outer peripheral surface 30*d*. In this way, the airflow generated by rotation of first blade member 31 is rectified by second blade member 32. The airflow flowing along inclined surface 30*c* to the downstream side of boss 30 therefore increases. Because sufficient airflow passes along inclined surface 30*c*, flow separation region 20 generated on the downstream side of boss 30 is still smaller.

Next, a description is given of advantageous effects of the present embodiment.

Regarding fan 3 in the present embodiment, rotation of first blade member 31 causes airflow to be generated in direction B from second end 30*b* to first end 30*a*. Because rotation of second blade member 32 causes a negative pressure in the region where second blade member 32 rotates, the airflow enters the region where second blade member 32 rotates. The airflow is thus drawn toward boss 30. The airflow generated by rotation of first blade member 31 therefore passes in the direction from second end 30*b* to first end 30*a* while drawn toward boss 30. In this way, the airflow generated by rotation of first blade member 31 and passing in the direction from second end 30*b* to first end 30*a* can be rectified by second blade member 32. Accordingly, the airflow passing along inclined surface 30*c* to the downstream side of boss 30 increases. The airflow can therefore be passed sufficiently along inclined surface 30*c*. Flow separation region 20 generated on the downstream side of boss 30 can thus be reduced sufficiently. Generation of eddies on the downstream side of boss 30 can therefore be suppressed. A loss of pressure-flow characteristics due to generation of eddies can therefore be reduced. Noise caused by generation of eddies can also be reduced.

As long as second blade member 32 is connected to at least one of inclined surface 30*c* or outer peripheral surface 30*d* located between inclined surface 30*c* and connecting portion CP where first blade member 31 is connected to outer peripheral surface 30*d*, the above-described advantageous effects can be produced. Therefore, in the case where second blade member 32 is connected to both inclined surface 30*c* and outer peripheral surface 30*d* like that of fan 3 in the present embodiment shown in FIG. 5, the above-described advantageous effects can be produced. The above-described advantageous effects can also be produced in the case where second blade member 32 is connected to inclined surface 30*c* only like that of Fan 3 according to the first modification in the present embodiment shown in FIG. 9. The above-described advantageous effects can also be produced in the case where second blade member 32 is connected to outer peripheral surface 30*d* only like the second modification in the present embodiment shown in FIG. 10.

Regarding fan 3 according to the third modification in the present embodiment shown in FIG. 11, second blade member 32 has third blade 32*c* in addition to first blade 32*a* and second blade 32*b*. It is therefore possible to further draw the airflow toward boss 30, relative to the case where second blade member 32 has first blade 32*a* and second blade 32*b* only.

Regarding fan 3 according to the fourth modification in the present embodiment shown in FIG. 12, through hole 33 in inclined surface 30*c* is located outside first blade 32*a* in the radial direction of boss 30. The airflow can thus be passed from inside boss 30 via through hole 33 to the downstream side of boss 30. The air-blowing efficiency can thus be increased to a further extent.

The outdoor unit in the present embodiment includes fan 3 and heat exchanger 8 as described above. It is therefore possible to sufficiently reduce flow separation region 20 generated on the downstream side of boss 30 of fan 3. On the downstream side of boss 30, generation of eddies can therefore be suppressed. In this way, the outdoor unit that enables reduction of a loss of pressure-flow characteristics due to generation of eddies can be obtained. The outdoor unit that also enables reduction of noise due to generation of eddies can also be obtained.

Second Embodiment

In the following, the same part as the first embodiment is denoted by the same reference character and the description thereof is not repeated, unless otherwise specified. The same is applied as well to third to sixth embodiments in the following.

Figure 16:
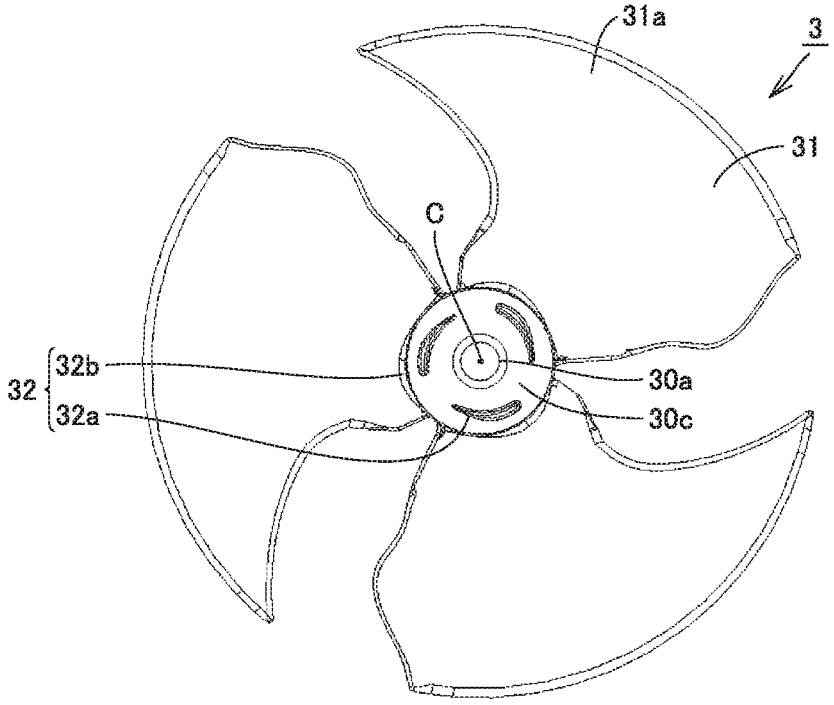
FIG. 16 is a front view showing a fan in a second embodiment of the present invention.

FIG. 16 is a front view of fan 3 in a second embodiment of the present invention as seen from the axially downstream side. With reference to FIG. 16, second blade member 32 of fan 3 in the second embodiment of the present invention has a centrifugal vane shape. The centrifugal vane shape is a shape with the distance from axial center C of boss 30 varying continuously in the direction from the radially inside to the radially outside of boss 30. In the present embodiment, second blade member 32 has first blade 32*a* and second blade 32*b*. First blade 32*a* and second blade 32*b* each have the centrifugal vane shape.

Second blade member 32 may have an airfoil vane shape. The airfoil vane shape is a shape whose thickness gradually increases from the front end of the blade toward the center of the blade and then gradually decreases from the center of the blade toward the rear end of the blade, around axial center C of boss.

Next, modifications of fan 3 in the second embodiment of the present invention are described.

Figure 17:
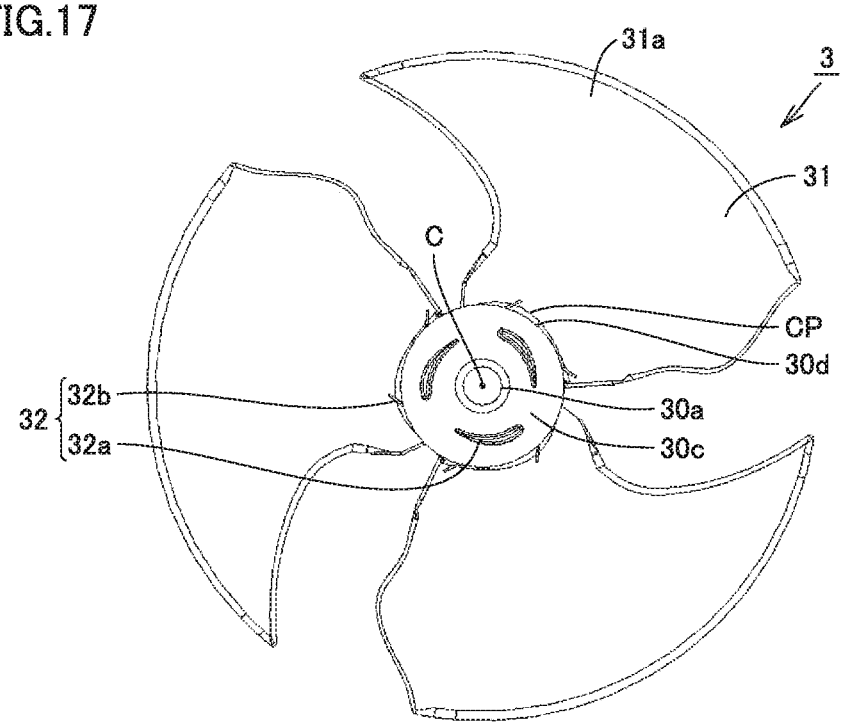
FIG. 17 is a front view showing a fan according to a first modification in the second embodiment of the present invention.

FIG. 17 is a front view of fan 3 according to a first modification in the second embodiment of the present invention as seen from the axially downstream side. With reference to FIG. 17, fan 3 according to the first modification in the second embodiment of the present invention differs from fan 3 in the second embodiment of the present invention shown in FIG. 16 in that second blade member 32 of the former has a flat plate shape. Regarding the fan of the first modification in the second embodiment of the present invention, second blade 32*b* of second blade member 32 has a flat plate shape. The flat plate shape extends along axial center C and located between inclined surface 30*c* and connecting portion CP where first blade member 31 is connected to outer peripheral surface 30*d*. Regarding fan 3 according to the first modification in the second embodiment of the present invention, five second blades 32*b* are placed. Five second blades 32*b* are spaced from each other at regular angles in the direction of the circumference of boss 30 about axial center C.

Figure 18:
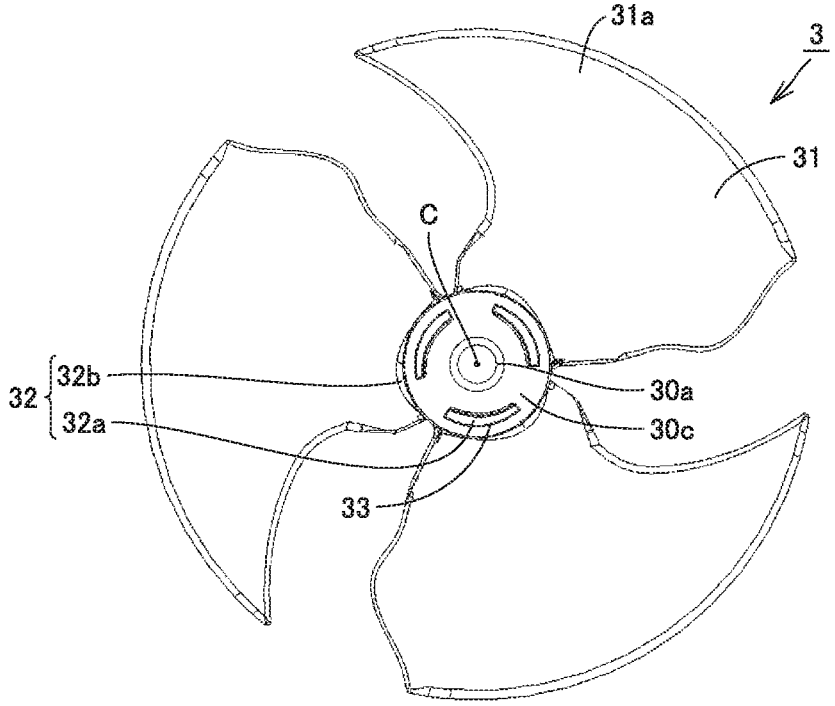
FIG. 18 is a front view showing a fan according to a second modification in the second embodiment of the present invention.

FIG. 18 is a front view of fan 3 according to a second modification in the second embodiment of the present invention as seen in the axially downstream side. With reference to FIG. 18, fan 3 according to the second modification in the second embodiment of the present invention may have a through hole 33. In fan 3 according to the second modification in the second embodiment of the present invention, through hole 33 is formed in inclined surface 30*c*. Through hole 33 extends through inclined surface 30*c* in the thickness direction. A plurality of through holes 33 are formed. A plurality of through holes 33 are each located outside a corresponding one of a plurality of first blades 32*a* in the radial direction of boss 30.

Next, advantageous effects of the present embodiment are described.

Regarding fans 3 in the second embodiment, the first modification, and the second modification of the present invention, flow separation region 20 generated on the downstream side of boss 30 can be reduced sufficiently, like fan 3 in the first embodiment. Further, because second blade member 32 has a centrifugal vane shape, airflow passing downstream of boss 30 can be rectified by means of the centrifugal vane shape.

Regarding fan 3 according to the second modification in the second embodiment of the present invention shown in FIG. 18, through holes 33 are formed in inclined surface 30*c* and located outside respective first blades 32*a* in the radial direction of boss 30, and therefore, airflow can be passed from inside boss 30 toward the downstream side of boss 30 via through hole 33. Accordingly, the air-blowing efficiency can further be increased.

Third Embodiment

Figure 19:
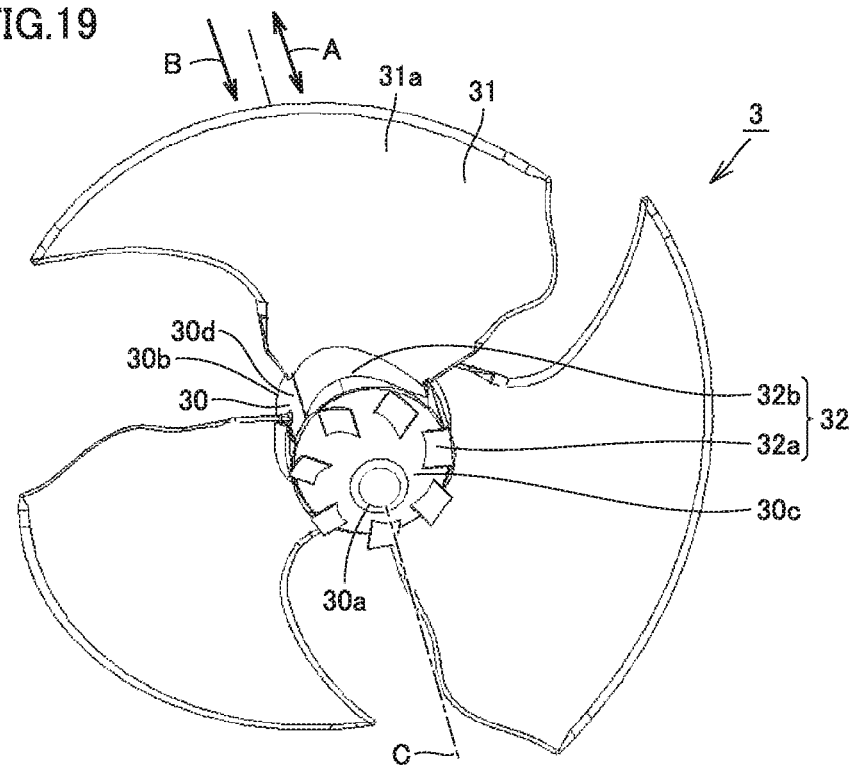
FIG. 19 is a perspective view showing a fan in a third embodiment of the present invention.
Figure 20:
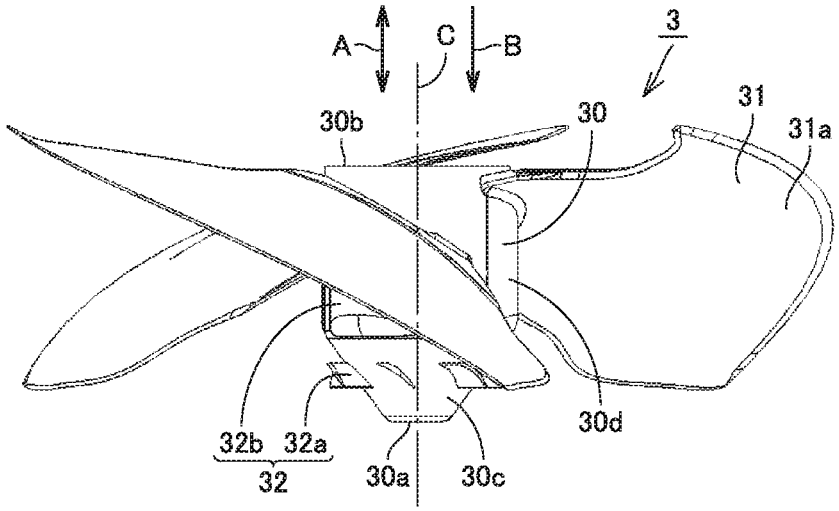
FIG. 20 is a side view showing the fan in the third embodiment of the present invention.

FIG. 19 is a perspective view of fan 3 in a third embodiment of the present invention as seen from the downstream side. FIG. 20 is a diagram of fan 3 in the third embodiment of the present invention as seen from a lateral side. With reference to FIGS. 19 and 20, second blade member 32 of fan 3 in the third embodiment of the present invention has a propeller vane shape. The propeller vane shape is a shape of a blade inclined with respect to axial center C extending in axial direction A of boss 30. The propeller vane shape is formed to allow airflow to pass in direction B from second end 30*b* to first end 30*a* by rotation of boss 30 about axial center C.

In the third embodiment of the present invention, second blade member 32 has a first blade 32*a* and a second blade 32*b*. First blade 32*a* has the propeller vane shape. First blades 32*a* are arranged on inclined surface 30*c*. Alternatively, first blade 32*a* may have an airfoil vane shape.

Next, modifications of fan 3 in the third embodiment of the present invention are described.

Figure 21:
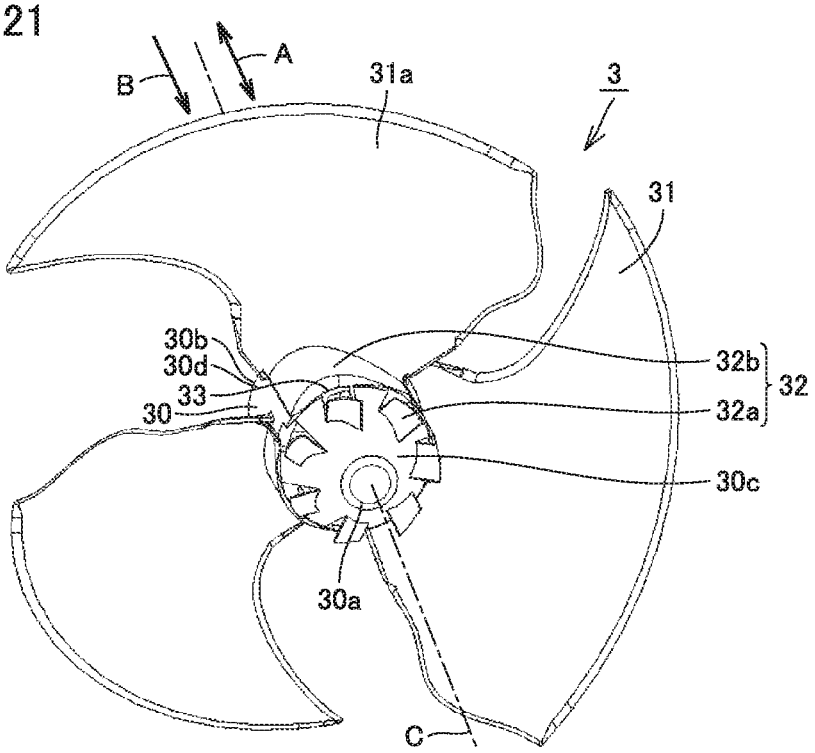
FIG. 21 is a perspective view showing a fan according to a first modification in the third embodiment of the present invention.
Figure 22:
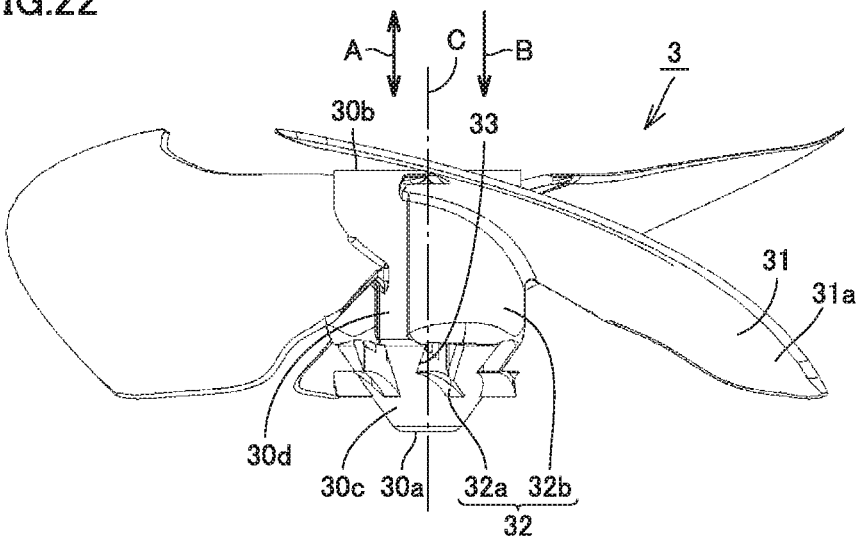
FIG. 22 is a side view showing the fan according to the first modification in the third embodiment of the present invention.

FIG. 21 is a perspective view of fan 3 according to a first modification in the third embodiment of the present invention as seen from the downstream side. FIG. 22 is a diagram of fan 3 according to the first modification in the third embodiment of the present invention as seen from a lateral side. With reference to FIGS. 21 and 22, fan 3 according to the first modification in the third embodiment of the present invention may have a through hole 33. Regarding fan 3 according to a second modification in the third embodiment of the present invention, through hole 33 is formed in inclined surface 30*c*. Through hole 33 extends through inclined surface 30*c* in the thickness direction. A plurality of through holes 33 are formed. A plurality of through holes 33 are located outside a plurality of first blades 32*a* in the radial direction of boss 30. Specifically, in the radial direction of boss 30, through holes 33 are located outside the connecting portion where first blade 32*a* is connected to inclined surface 30*c*.

Figure 23:
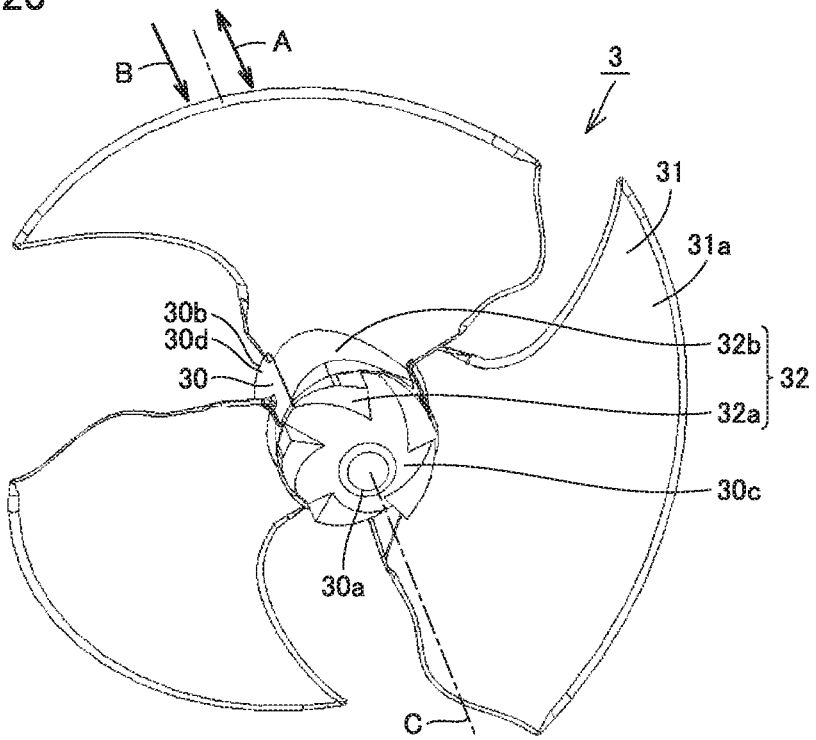
FIG. 23 is a perspective view showing a fan according to a second modification in the third embodiment of the present invention.
Figure 24:
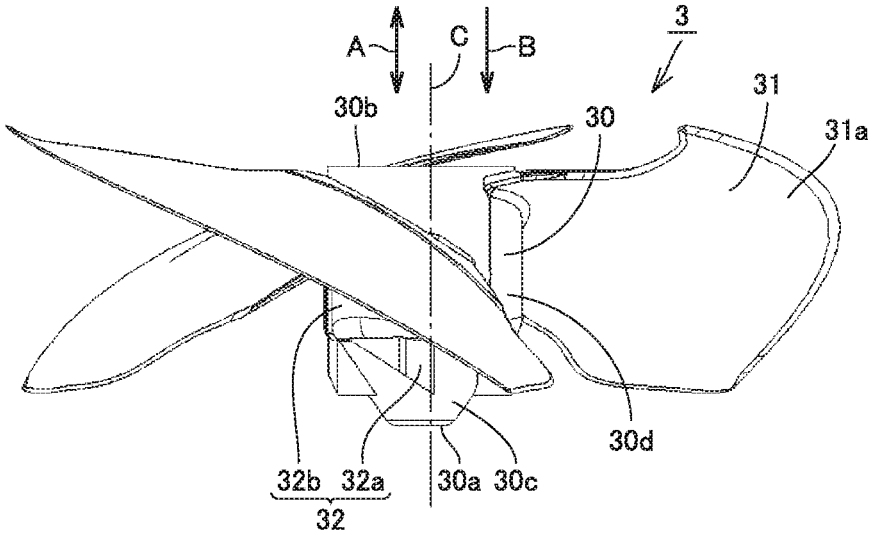
FIG. 24 is a side view showing the fan according to the second modification in the third embodiment of the present invention.

FIG. 23 is a perspective view of fan 3 according to a second modification in the third embodiment of the present invention as seen from the downstream side. FIG. 24 is a diagram of fan 3 according to the second modification in the third embodiment of the present invention as seen from a lateral side. With reference to FIGS. 23 and 24, fan 3 according to the second modification in the third embodiment of the present invention differs from the third embodiment of the present invention shown in FIGS. 19 and 20 in terms of the shape of first blade 32*a* of second blade member 32. Regarding fan 3 according to the second modification in the third embodiment of the present invention, first blade 32*a* protrudes from outer peripheral surface 30*d* in direction B from second end 30*b* to first end 30*a*.

Next, advantageous effects of the present embodiment are described.

Regarding fans 3 in the third embodiment, the first modification, and the second modification of the present invention, flow separation region 20 generated on the downstream side of boss 30 can also be reduced sufficiently, like fan 3 in the first embodiment. Further, because second blade member 32 has the propeller vane shape placed on inclined surface 30*c*, second blade member 32 can rectify airflow passing to the downstream side of boss 30, by means of the propeller vane shape.

Because second blade member 32 has the propeller vane shape, rotation of first blade 32*a* of second blade member 32 about axial center C of boss 40 enables the pressure to increase, like blade 31*a* of first blade member 31. Airflow passing in direction B from second end 30*b* to first end 30*a* thus increases. Accordingly, flow separation region 20 generated on the downstream side of boss 30 can be reduced sufficiently.

Regarding fan 3 according to the first modification in the third embodiment of the present invention shown in FIGS. 21 and 22, through hole 33 is formed in inclined surface 30*c* and located outside first blade 32*a* in the radial direction of boss 30. Airflow can therefore be passed from inside boss 30 via through hole 33 toward the downstream side of boss 30. In this way, the air-blowing efficiency can further be increased.

Fourth Embodiment

Figure 25:
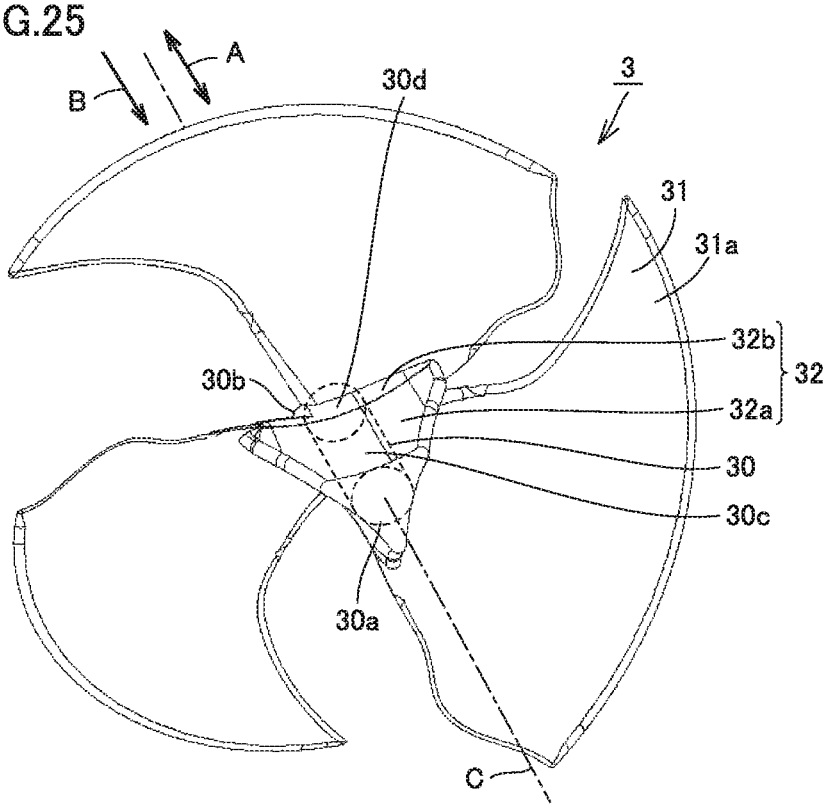
FIG. 25 is a perspective view showing a fan in a fourth embodiment of the present invention.
Figure 26:
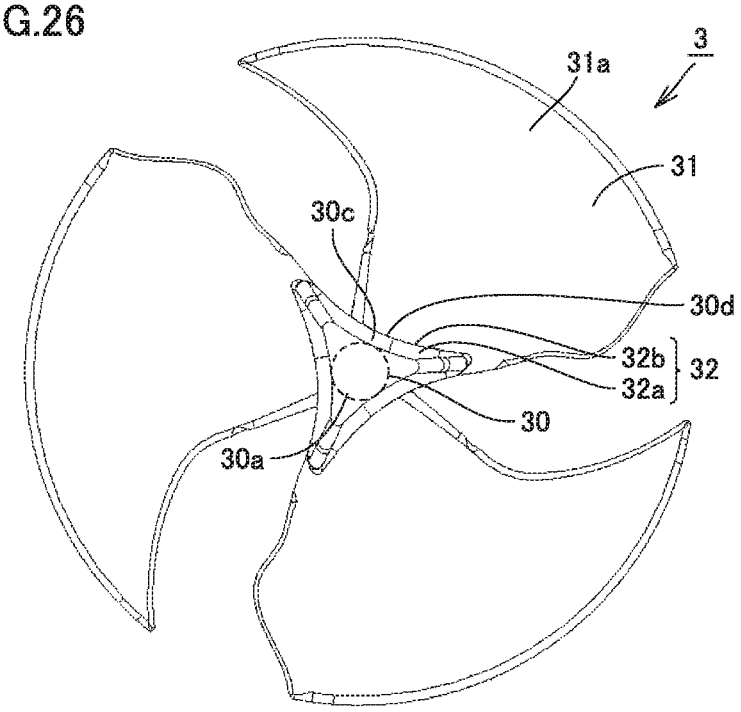
FIG. 26 is a front view showing the fan in the fourth embodiment of the present invention.

FIG. 25 is a perspective view of fan 3 in a fourth embodiment of the present invention as seen from the downstream side. FIG. 26 is a front view of fan 3 in the fourth embodiment of the present invention as seen from the axially downstream side. With reference to FIGS. 25 and 26, fan 3 in the fourth embodiment of the present invention differs from fan 3 in the first embodiment in terms of the configuration of boss 30 and second blade member 32.

Regarding fan 3 in the fourth embodiment of the present invention, boss 30 and second blade member 32 are formed as a single unit. First end 30*a* and second end 30*b* each have a substantially triangular shape. Boss 30 is formed by the portion extending from an inscribed circle in the substantially triangular shape of first end 30*a* to an inscribed circle in the substantially triangular shape of second end 30*b*. Boss 30 has a cylindrical shape whose diameter increases from first end 30*a* toward outer peripheral surface 30*d* as shown by the dotted lines in the drawings. A surface of the cylindrical shape defines inclined surface 30*c*.

Second blade member 32 continues to inclined surface 30*c* and outer peripheral surface 30*d*. The continuous extension of second blade member 32, inclined surface 30*c*, and outer peripheral surface 30*d* form an arc vane. Fan 3 in the fourth embodiment of the present invention is equipped with three arc vanes. In other words, fan 3 in the fourth embodiment of the present invention is equipped with multiple arc vanes.

Second blade member 32 has a first blade 32*a* and a second blade 32*b*. First blade 32*a* continues to inclined surface 30*c*. First blade 32*a* and inclined surface 30*c* form a continuous curved surface. First blade 32*a* is inclined with its cross-sectional area decreasing in direction B from second end 30*b* to first end 30*a*. Second blade 32*b* continues to outer peripheral surface 30*d*. Second blade 32*b* and outer peripheral surface 30*d* form a continuous curved surface. First blade 32*a* is connected to second blade 32*b* in axial direction A. Second blade 32*b* may be inclined with its cross-sectional area decreasing in direction B from second end 30*b* to first end 30*a*.

Next, a modification of fan 3 in the fourth embodiment of the present invention is described.

Figure 27:
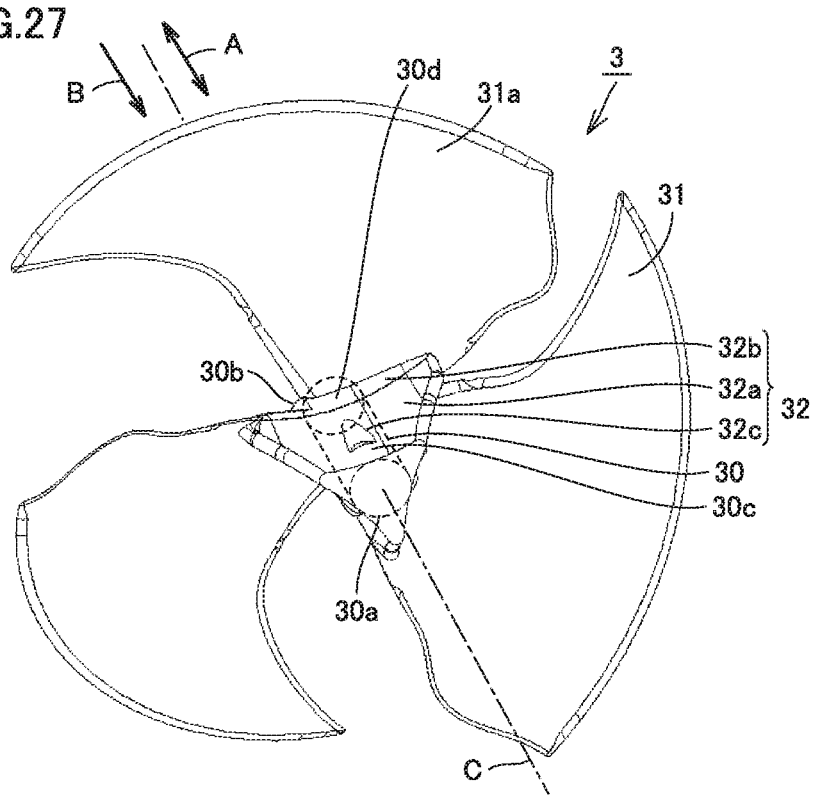
FIG. 27 is a perspective view showing a fan according to a first modification in the fourth embodiment of the present invention.
Figure 28:
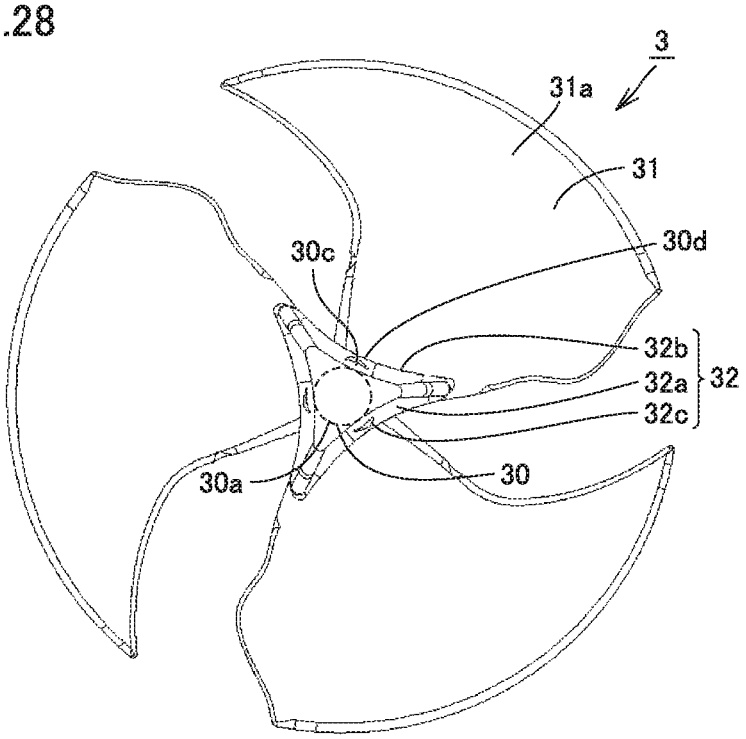
FIG. 28 is a front view showing the fan according to the first modification in the fourth embodiment of the present invention.

FIG. 27 is a perspective view of fan 3 according to a first modification in the fourth embodiment of the present invention as seen from the downstream side. FIG. 28 is a front view of fan 3 according to the first modification in the fourth embodiment of the present invention as seen from the axially downstream side. With reference to FIGS. 27 and 28, second blade member 32 of fan 3 according to the first modification in the fourth embodiment of the present invention has a third blade 32*c* in addition to first blade 32*a* and second blade 32*b*. Third blade 32*c* is connected to inclined surface 30*c*. Third blade 32*c* protrudes outward from inclined surface 30*c*. Third blade 32*c* is formed with its width increasing in direction B from second end 30*b* to first end 30*a*. Third blade 32*c* may have a centrifugal vane shape. Alternatively, third blade 32*c* may have an airfoil vane shape.

Next, advantageous effects of the present embodiment are described.

Regarding fans 3 in the fourth embodiment and the first modification of the present invention, flow separation region 20 generated on the downstream side of boss 30 can be reduced sufficiently like fan 3 in the first embodiment. Further, because second blade member 32 continues to inclined surface 30*c* and outer peripheral surface 30*d*, rotation of second blade member 32 about axial center A of boss 30 enables a large pressure increase. With resultant flow of air, the airflow passing on the downstream side of boss 30 can be increased.

Regarding fan 3 according to the first modification in the present embodiment shown in FIGS. 27 and 28, second blade member 32 has third blade 32*c* in addition to first blade 32*a* and second blade 32*b*, and therefore, the airflow can be drawn closer toward boss 30, as compared with fan 3 having first blade 32*a* and second blade 32*b* only.

Fifth Embodiment

Figure 29:
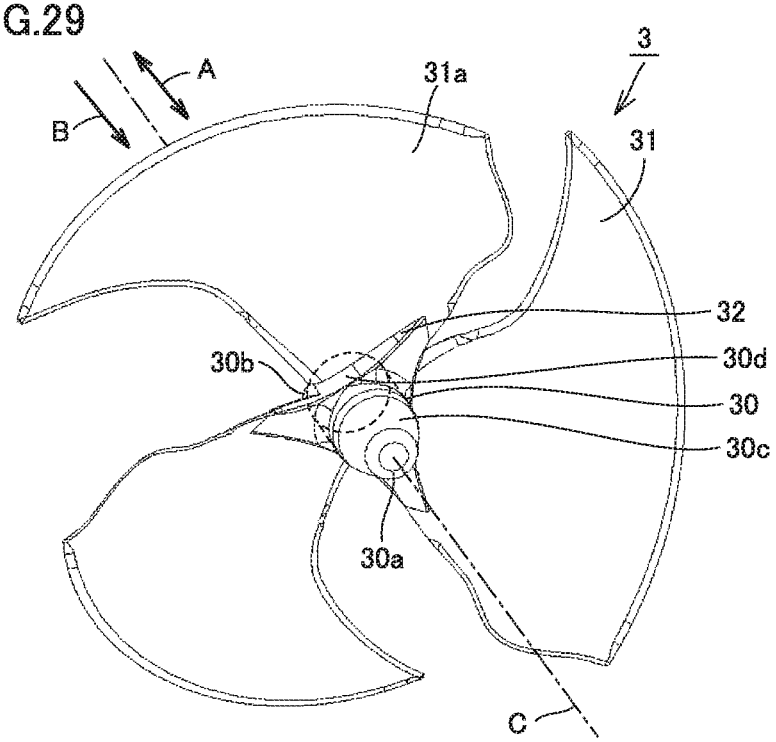
FIG. 29 is a perspective view showing, a fan in a fifth embodiment of the present invention.
Figure 30:
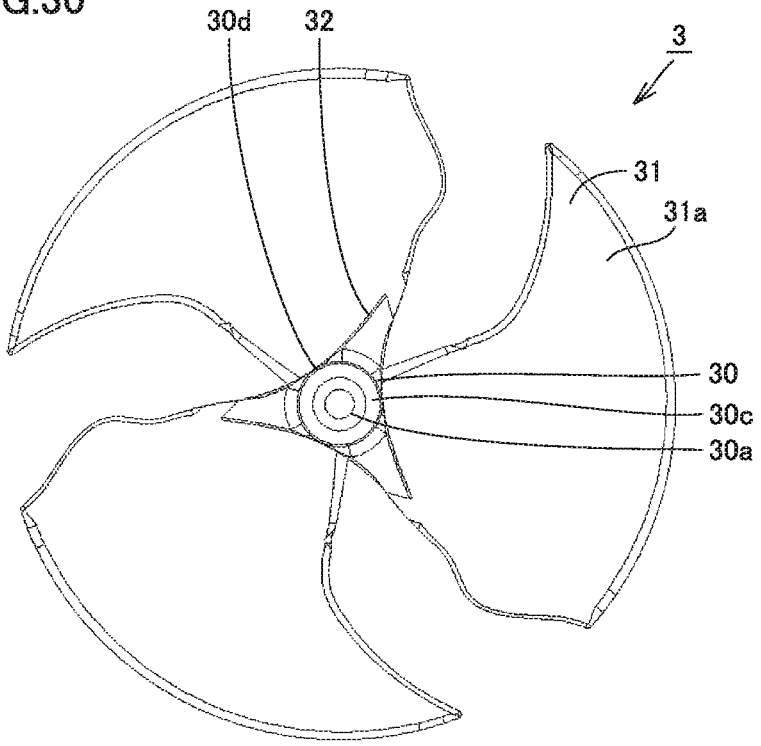
FIG. 30 is a front view showing the fan in the fifth embodiment of the present invention.

FIG. 29 is a perspective view of fan 3 in a fifth embodiment of the present invention as seen from the downstream side. FIG. 30 is a front view of fan 3 in the fifth embodiment of the present invention as seen from the axially downstream side. With reference to FIGS. 29 and 30, fan 3 in the fifth embodiment of the present invention differs from fan 3 in the first embodiment in terms of the configuration of boss 30 and second blade member 32.

Regarding fan 3 in the fifth embodiment of the present invention, boss 30 and second blade member 32 are formed as a single unit. Second end 30*b* has a substantially triangular shape. Boss 30 has inclined surface 30*c* and outer peripheral surface 30*d*. Boss 30 has a cylindrical shape. A surface of the cylindrical shape defines outer peripheral surface 30*d*. Inclined surface 30*c* is connected to outer peripheral surface 30*d* in direction B from second end 30*b* to first end 30*a*.

Second blade member 32 continues to outer peripheral surface 30*d*. The continuous extension of second blade member 32 and outer peripheral surface 30*d* forms an arc vane. Fan 3 in the fifth embodiment of the present invention is equipped with three arc vanes. In other words, fan 3 in the fifth embodiment of the present invention is equipped with multiple arc vanes.

Second blade member 32 and outer peripheral surface 30*d* form a continuous curved surface. Second blade member 32 may be inclined with its cross-sectional area decreasing in direction B from second end 30*b* to first end 30*a*.

Next, a modification of fan 3 in the fifth embodiment of the present invention is described.

Figure 31:
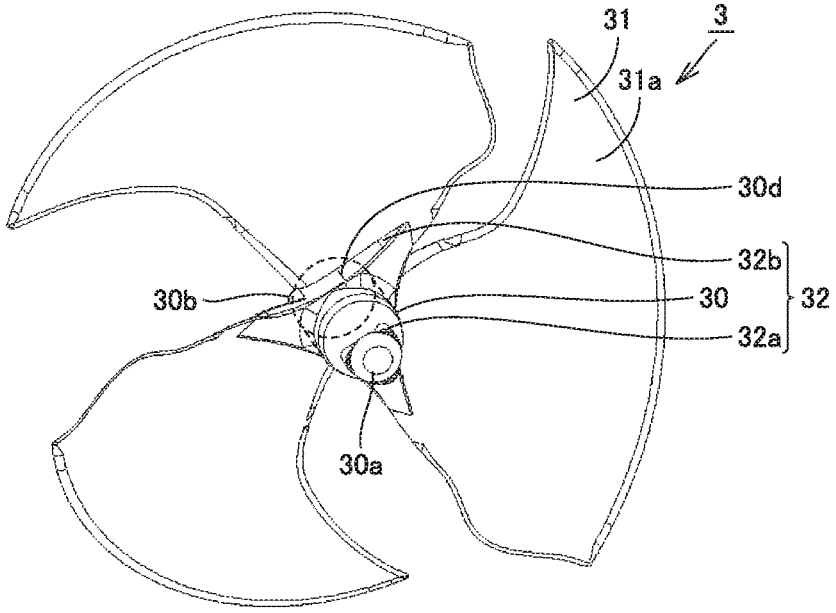
FIG. 31 is a perspective view showing a fan according to a first modification in the fifth embodiment of the present invention.
Figure 32:
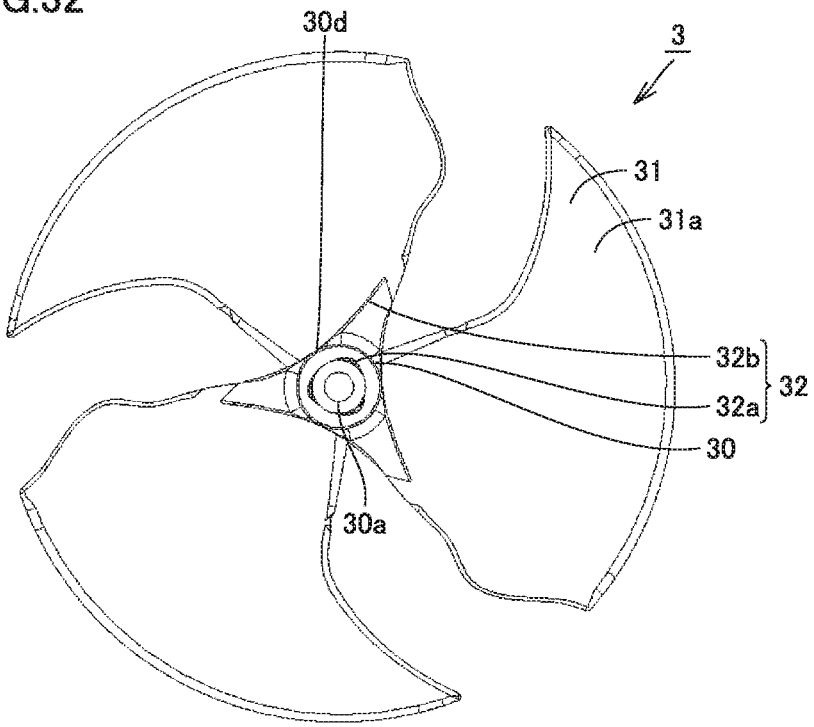
FIG. 32 is a front view showing the fan according to the first modification in the fifth embodiment of the present invention.

FIG. 31 is a perspective view of fan 3 according to a first modification in the fifth embodiment of the present invention as seen from the downstream side. FIG. 32 is a front view of fan 3 according to the first modification in the fifth embodiment of the present invention as seen from the axially downstream side. With reference to FIGS. 31 and 32, according to the first modification of fan 3 in the fifth embodiment of the present invention, second blade member 32 has a first blade 32*a* and a second blade 32*b*. First blade 32*a* is connected to inclined surface 30*c*. First blade 32*a* protrudes outward from inclined surface 30*c*. First blade 32*a* is formed with its width increasing in direction B from second end 30*b* to first end 30*a*. First blade 32*a* may have a centrifugal vane shape. Alternatively, first blade 32*a* may have an airfoil vane shape. Second blade 32*b* and outer peripheral surface 30*d* form a continuous curved surface. Second blade 32*b* may be inclined with its cross-sectional area decreasing in direction B from second end 30*b* to first end 30*a*.

Next, advantageous effects of the present embodiment are described.

Regarding fans 3 in the fifth embodiment and the first modification of the present invention, flow separation region 20 generated on the downstream side of boss 30 can be reduced sufficiently, like fan 3 in the first embodiment. Further, because second blade member 32 continues to outer peripheral surface 30*d*, rotation of second blade member 32 about axial center A of boss 30 enables a large pressure increase. With resultant flow of air, the airflow passing to the downstream side of boss 30 can be increased.

Regarding fan 3 according to the first modification in the present embodiment shown in FIGS. 31 and 32, second blade member 32 has first blade 32*a* and second blade 32*b*, and therefore, airflow can be drawn closer toward boss 30, as compared with second blade member 32 having second blade 32*b* only.

Sixth Embodiment

Figure 33:
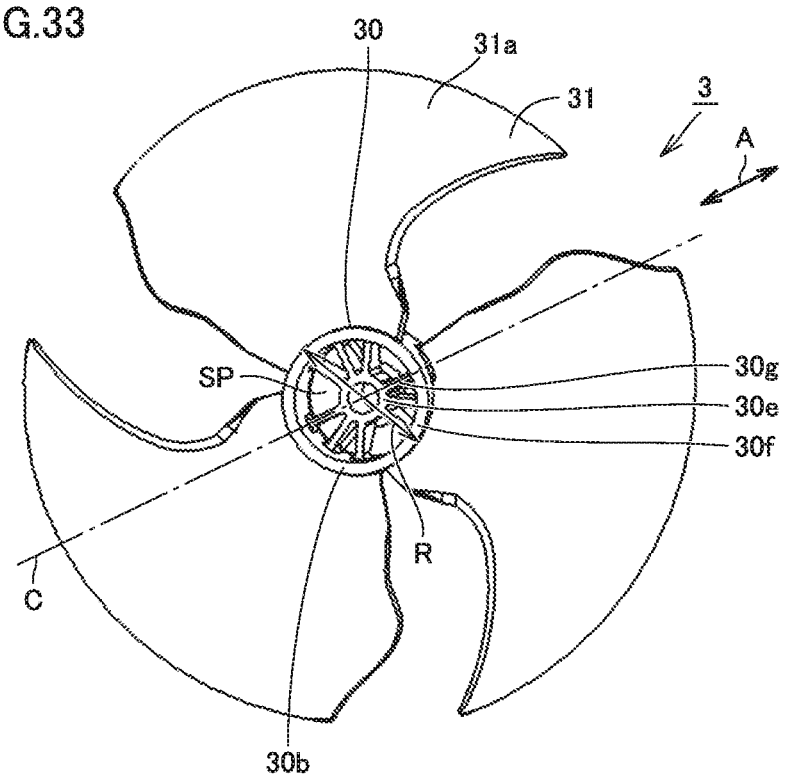
FIG. 33 is a perspective view showing a fan in a sixth embodiment of the present invention.

FIG. 33 is a perspective view of fan 3 in a sixth embodiment of the present invention as seen from the upstream side. With reference to FIG. 33 boss 30 in the present embodiment has a hollow shape and has a rib 30*g* for ensuring the strength of fan 3.

Boss 30 has a central portion 30*e*, an outer peripheral portion 30*f*, and rib 30*g*. Central portion 30*e* is located at the center in radial direction R which is transverse to axial direction A of boss 30. Outer peripheral portion 30*f* is located outward of central portion 30*e* and separated by a space SP from central portion 30*e* in radial direction R which is transverse to axial direction A of boss 30. Rib 30*g* is located in space SP. Rib 30*g* connects central portion 30*e* to outer peripheral portion 30*f* in radial direction R. Rib 30*g* extends in radial direction R. Rib 30*g* may be located at the connecting portion where boss 30 and first blade member 31 are connected to each other in the circumferential direction of boss 30.

Next, advantageous effects of the present embodiment are described.

Regarding fan 3 in the sixth embodiment of the present invention, flow separation region 20 generated on the downstream side of boss 30 can also be reduced sufficiently, like fan 3 in the first embodiment. Further, regarding fan 3 in the sixth embodiment of the present invention, the strength of fan 3 can be ensured by rib 30*g* connecting central portion 30*e* to outer peripheral portion 30*f* in radial direction R.

Rib 30*g* which is located at the connecting portion where boss 30 and blade 31*a* of first blade member 31 are connected to each other in the circumferential direction of boss 30 can reinforce the connecting portion where boss 30 and blade 31*a* of first blade member 31 are connected to each other, which is a portion where the stress is concentrated to the maximum extent. In this way, the strength of fan 3 can be improved effectively.

Seventh Embodiment

Figure 34:
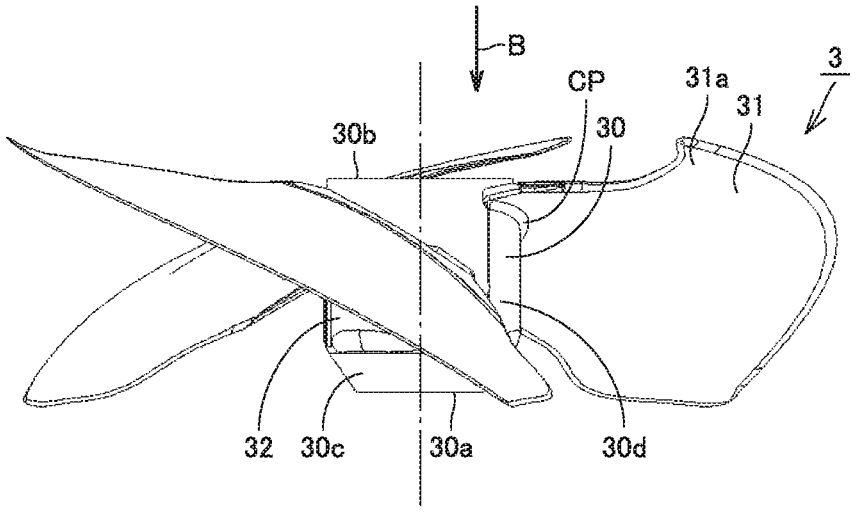
FIG. 34 is a side view showing a fan in a seventh embodiment of the present invention.

FIG. 34 is a diagram of fan 3 in a seventh embodiment of the present invention as seen from a lateral side. With reference to FIG. 34, regarding fan 3 in the seventh embodiment of the present invention, the downstream end of boss 30 is located downstream of connecting portion CP where boss 30 and first blade member 31 are connected to each other. In other words, in direction B from second end 30*b* to first end 30*a*, inclined surface 30*c* is located closer to first end 30*a* of boss 30, than to connecting portion CP where boss 30 and first blade member 31 are connected to each other.

Regarding fan 3 in the seventh embodiment of the present invention, flow separation region 20 generated on the downstream side of boss 30 can be reduced sufficiently, like fan 3 in the first embodiment. Further, regarding the fan in the seventh embodiment of the present invention, the downstream end of boss 30 is located downstream of connecting portion CP where boss 30 and first blade member 31 are connected to each other. Thus, the airflow passing downstream from first blade member 31 proceeds along outer peripheral surface 30*d* and inclined surface 30*c*. Separation of the airflow from boss 30 can therefore be suppressed. Disturbance of the airflow can thus be suppressed. Accordingly, deterioration of pressure-flow characteristics can be suppressed.

Eighth Embodiment

Figure 35:
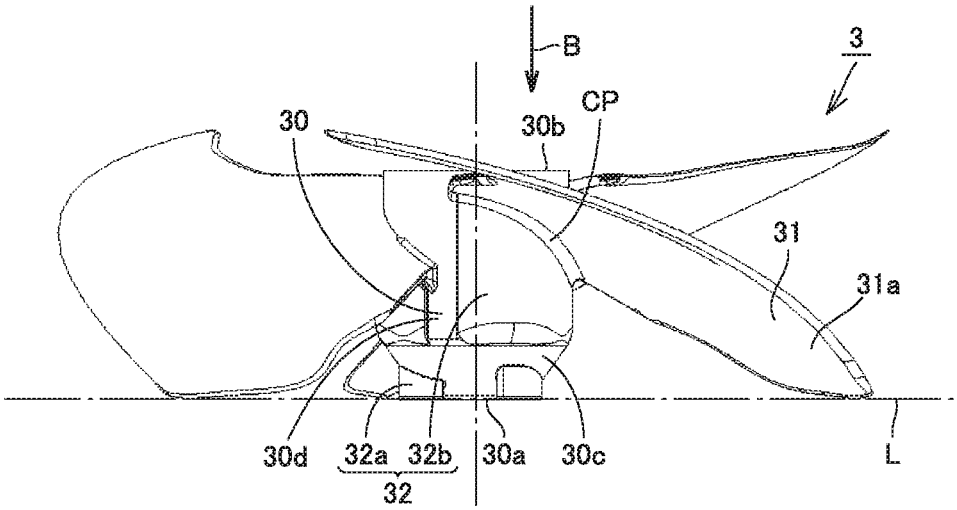
FIG. 35 is a side view showing a fan in an eighth embodiment of the present invention.

FIG. 35 is a diagram of fan 3 in an eighth embodiment of the present invention as seen from a lateral side. With reference to FIG. 35, regarding fan 3 in the eighth embodiment of the present invention, the downstream end of boss 30 is located downstream of connecting portion CP where boss 30 and first blade member 31 are connected to each other, and the downstream end of boss 30 is located at the same position as the most downstream edge of first blade member 31. In other words, in direction B from second end 30*b* to first end 30*a*, the edge of first blade member 31 is located at the same position as first end 30*a* of boss 30. In FIG. 35, the position of the most downstream edge of first blade member 31 is indicated by line L.

Figure 36:
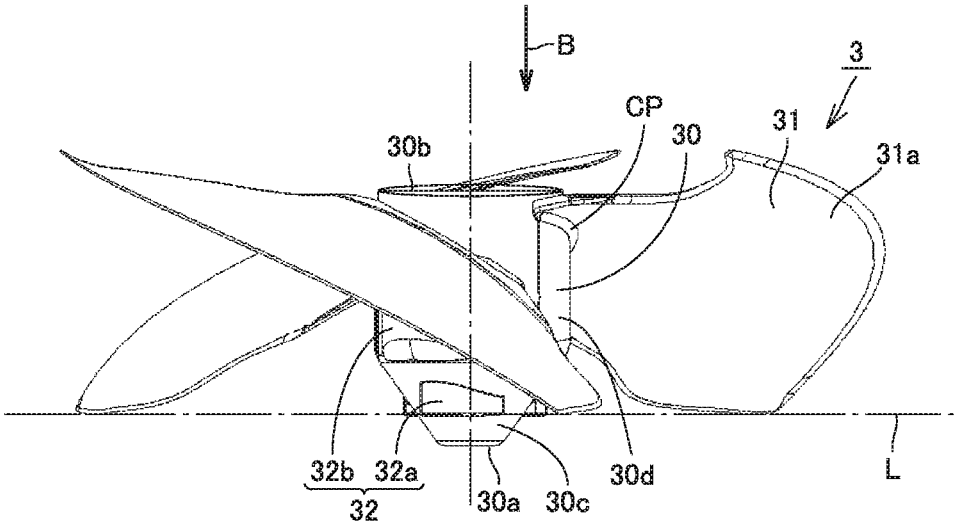
FIG. 36 is a side view showing a fan according to a first modification in the eighth embodiment of the present invention.

FIG. 36 is a diagram of fan 3 according to a first modification in the eighth embodiment of the present invention as seen from a lateral side. With reference to FIG. 36, regarding fan 3 according to the first modification in the eighth embodiment of the present invention, the downstream end of boss 30 is located downstream of connecting portion CP where boss 30 and first blade member 31 are connected to each other, and the downstream end of boss 30 is also located downstream of the most downstream edge of first blade member 31. In other words, the edge of first blade member 31 is located away from the position of first end 30*a* of the boss toward the second end 30*b* of the boss, with respect to direction B from second end 30*b* to first end 30*a*. In FIG. 36, the position of the most downstream edge of first blade member 31 is indicated by line L.

Fans 3 in the eighth embodiment and the first modification of the present invention also enable flow separation region 20 generated on the downstream side of boss 30 to be reduced sufficiently, like fan 3 in the first embodiment. Further, with respect to direction B from second end 30*b* to first end 30*a*, the edge of first blade member 31 is located away from first end 30*a* of boss 30 toward second end 30*b* of boss 30. Therefore, the airflow passing downstream from first blade member 31 is guided closer to and along outer peripheral surface 30*d* and inclined surface 30*c*. Separation of the airflow from boss 30 is thus suppressed to a greater extent. Disturbance of the airflow can therefore be suppressed. Accordingly, deterioration of pressure-flow characteristics can be suppressed.

Ninth Embodiment

Figure 37:
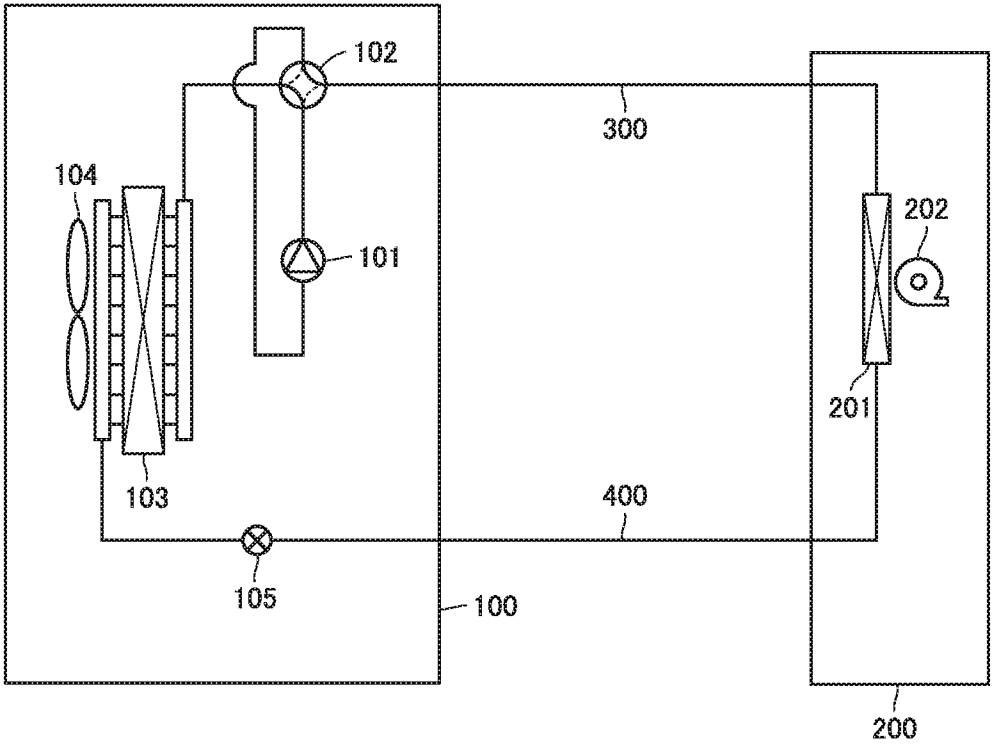
FIG. 37 is a configuration diagram of an air conditioning apparatus in a ninth embodiment of the present invention.

FIG. 37 is a configuration diagram of an air conditioning apparatus in a ninth embodiment of the present invention. With reference to FIG. 37, regarding the ninth embodiment of the present invention, a description is given of a refrigeration cycle apparatus having an outdoor unit 100 equipped with components such as fan 3 as described above. Regarding the ninth embodiment of the present invention, an air conditioning apparatus is described as an example of the refrigeration cycle apparatus in the ninth embodiment of the present invention.

The air conditioning apparatus includes outdoor unit 100 and an indoor unit 200. Outdoor unit 100 and indoor unit 200 are connected together by a refrigerant pipe to form a refrigerant circuit in which refrigerant is circulated. The refrigerant pipe includes a gas pipe 300 in which refrigerant in gas phase (gas refrigerant) flows, and a liquid pipe 400 in which refrigerant in liquid phase (liquid refrigerant which may be gas-liquid two-phase refrigerant) flows.

Outdoor unit 100 in the present embodiment has a compressor 101, a four-way valve 102, an outdoor heat exchanger 103, an outdoor fan 104, and a throttle device (expansion valve) 105.

Compressor 101 sucks in, compresses, and discharges refrigerant. Compressor 101 herein includes an inverter or the like for varying the operating frequency in any manner so that the capacity (the amount of refrigerant discharged per unit time) of compressor 101 can be varied finely. Four-way valve 102 switches the refrigerant flow depending on whether the operation is cooling operation or heating operation, in accordance with an instruction from a controller (not shown).

Outdoor heat exchanger 103 exchanges heat between refrigerant and air (outdoor air). For example, during the heating operation, outdoor heat exchanger 103 functions as an evaporator exchanging heat between air and low-pressure refrigerant flowing from liquid pipe 400 to cause the refrigerant to evaporate into vapor. During the cooling operation, outdoor heat exchanger 103 functions as a condenser exchanging heat between air and refrigerant compressed by compressor 101 and flowing from four-way valve 102 to condense the refrigerant into liquid. For efficient exchange of heat between refrigerant and air, outdoor heat exchanger 103 is equipped with outdoor fan 104 having fan 3 for example as described above in connection with the first to eighth embodiments. For outdoor fan 104 as well, an inverter may be used to change the operating frequency of the fan motor to finely vary the rotational speed of fan 3. Throttle device 105 is disposed for adjusting the refrigerant pressure for example by changing the degree of opening.

Indoor unit 200 has a load-side heat exchanger 201 and a load-side fan 202. Load-side heat exchanger 201 exchanges heat between refrigerant and air. For example, during the heating operation, load-side heat exchanger 201 functions as a condenser exchanging heat between air and refrigerant flowing from gas pipe 300 to condense the refrigerant into liquid (or into gas-liquid two-phase) and cause the refrigerant to flow to liquid pipe 400. During the cooling operation, load-side heat exchanger 201 functions as an evaporator exchanging heat between air and refrigerant whose pressure has been lowered by throttle device 105 for example, so that the refrigerant absorbing heat from the air is evaporated into vapor, and the refrigerant in vapor phase flows to gas pipe 300. Indoor unit 200 is equipped with load-side fan 202 for adjusting flow of air for heat exchanging. The operating speed of load-side fan 202 is determined by user's setting, for example. The fan described above in connection with the first to eighth embodiment can also be used as load-side fan 202, which, however, is not a particular restriction.

As described above, the refrigeration cycle in the present embodiment forms a refrigerant circuit including compressor 101, outdoor heat exchanger (condenser) 103, throttle device 105, and load-side heat exchanger (evaporator) 201 that are connected together by the pipe. Compressor 101 sucks in, compresses, and discharges refrigerant. Condenser 103 exchanges heat with refrigerant discharged from compressor 101 to condense the refrigerant. Throttle device 105 causes the refrigerant condensed by condenser 103 to be reduced in pressure. Evaporator 201 exchanges heat with the refrigerant whose pressure is reduced by throttle device 105 to thereby cause the refrigerant to evaporate. The outdoor unit in the first embodiment is either condenser 103 or evaporator 201.

As seen from the foregoing, for the refrigeration cycle apparatus in the ninth embodiment, fan 3 described above in connection with the first to eighth embodiments can be used for outdoor unit 100 to cause flow separation region 20 generated on the downstream side of boss 30 to be reduced sufficiently. Accordingly, generation of eddies on the downstream side of boss 30 can be suppressed. In this way, a loss of pressure-flow characteristics due to generation of eddies can be reduced. Noise due to generation of eddies can also be reduced.

The present invention is applicable to an outdoor unit as a component of a refrigeration cycle apparatus, such as outdoor units for air conditioner and water heater, for example, and also applicable to various apparatuses and installations equipped with a fan. The present invention is applicable widely to these various apparatuses and installations equipped with a fan.

It should be construed that the embodiments disclosed herein are given by way of illustration in all respects, not by way of limitation. It is intended that the scope of the present invention is defined by claims, not by the description above, and encompasses all modifications and variations equivalent in meaning and scope to the claims.

REFERENCE SIGNS LIST

1 outdoor unit body; 2 fan grille; 3 fan; 4 fan motor; 5 partition plate; 6 fan chamber; 7 machine chamber; 8 heat exchanger; 9 bell mouth; 10, 101 compressor; 11 pipe; 12 board box; 13 control board; 20 flow separation region; 30 boss; 30*a* first end; 30*b* second end; 30*c* inclined surface; 30*d* outer peripheral surface; 30*e* central portion; 30*f* outer peripheral portion; 30*g* rib; 31 first blade member; 31*a* blade; 32 second blade member; 32*a* first blade; 32*h* second blade; 32*c* third blade; 33 through hole; 100 outdoor unit; 102 four-way valve; 103 outdoor heat exchanger; 104 outdoor fan; 105 throttle device; 200 indoor unit; 201 load-side heat exchanger; 202 load-side fan; 300 gas pipe; 400 liquid pipe; A axial direction; B direction from second end to first end; C axial center; CP connecting portion; R radial direction; S airflow; SP space

The invention claimed is:

1. A fan comprising:

a boss having a first end and a second end in an axial direction, an inclined surface inclined, in a direction from the second end to the first end, toward an axial center extending in the axial direction, and an outer peripheral surface located between the inclined surface and the second end, the boss being rotatable about the axial center;

a first blade member connected to the outer peripheral surface of the boss; and a second blade member connected to at least one of the inclined surface or the outer peripheral surface located between the inclined surface and a connecting portion where the first blade member is connected to the outer peripheral surface, the second blade member comprising a first blade connected to the inclined surface and a second blade connected to the outer peripheral surface, wherein the first blade and the second blade are separate, wherein the first blade extends longitudinally along a direction of a circumference of the inclined surface, wherein, in a front view in the axial direction of the fan, an entirety of a radial outer periphery of the first blade is disposed inside a radial outer periphery of the boss, wherein the first blade is spaced apart in the axial direction of the boss from the first end of the boss and the outer peripheral surface of the boss.

2. The fan according to claim 1, wherein the second blade of the second blade member has a centrifugal vane shape, wherein the centrifugal vane shape is a shape with a distance from the axial center of the boss varying continuously in the direction from a radial inside of the boss to a radial outside of the boss.

3. The fan according to claim 1, wherein the first blade of the second blade member has a propeller blade shape disposed on the inclined surface, wherein the propeller blade shape is a shape of a blade inclined with respect to the axial center of the boss extending in the axial direction of the boss.

4. The fan according to claim 1, wherein the boss comprises:

a central portion;

an outer peripheral portion located outward of the central portion and separated by a space from the central portion in a radial direction transverse to the axial direction of the boss; and a rib located in the space and connecting the central portion to the outer peripheral portion in the radial direction.

5. The fan according to claim 1, wherein an edge of the first blade member is located between the first end of the boss and the second end of the boss, with respect to the direction from the second end to the first end.

6. An outdoor unit comprising:

the fan according to claim 1; and a heat exchanger to exchange heat with air guided by the fan.

7. A refrigeration cycle apparatus comprising:

an outdoor unit according to claim 6; and an indoor unit, the outdoor unit and the indoor unit having a compressor to suck in, compress, and discharge refrigerant;

a condenser to exchange heat with the refrigerant discharged from the compressor and thereby condense the refrigerant;

a throttle device to reduce pressure of the refrigerant condensed by the condenser; and an evaporator to evaporate the refrigerant by exchanging heat with the refrigerant whose pressure is reduced by the throttle device, the compressor, the condenser, the throttle device, and the evaporator being connected together by a pipe to form a refrigerant circuit, the heat exchanger being either the condenser or the evaporator.

8. The fan according to claim 1, wherein, in a side view of the fan, the first blade and the second blade are spaced apart from each other in the axial direction of the boss.

* * * * *